US007108347B2

(12) United States Patent
Miyashita

(10) Patent No.: US 7,108,347 B2
(45) Date of Patent: Sep. 19, 2006

(54) APPARATUS FOR DETERMINING DISCHARGING STATE OF LIQUID DROPLETS AND METHOD, AND INKJET PRINTER

(75) Inventor: Akira Miyashita, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 223 days.

(21) Appl. No.: 10/705,313

(22) Filed: Nov. 10, 2003

(65) Prior Publication Data

US 2004/0095410 A1 May 20, 2004

(30) Foreign Application Priority Data

Nov. 14, 2002 (JP) ..... 2002-331012

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 5,276,467 A 1/1994 Meyer et al.
5,350,929 A 9/1994 Meyer et al.
5,376,958 A 12/1994 Richtsmeier et al.
5,434,430 A 7/1995 Stewart
6,056,386 A 5/2000 Nohata et al.
6,419,341 B1 * 7/2002 Nohata et al. ..... 347/19
6,517,183 B1 * 2/2003 Bruch et al. ..... 347/19
6,752,483 B1 * 6/2004 Vega et al. ..... 347/19

FOREIGN PATENT DOCUMENTS

JP 11-170569 6/1999

* cited by examiner

*Primary Examiner*—Vip Patel
*Assistant Examiner*—Brian J. Goldberg
(74) *Attorney, Agent, or Firm*—Morgan & Finnegan, LLP

(57) ABSTRACT

In a discharging state determination method and apparatus for detecting discharging state from each nozzle of a printhead which discharges droplets, each of the nozzles of the printhead is driven, and the discharging state from each driven nozzle is detected and stored as a physical amount in a memory. A threshold for determining whether the discharging state of each nozzle of the printhead is normal or abnormal is calculated by using the physical amount corresponding to each nozzle and stored in the memory. The physical amount corresponding to each nozzle is evaluated on the basis of the threshold, and it is determined whether the droplet discharging state of each nozzle is normal or abnormal.

19 Claims, 13 Drawing Sheets

FIG. 13A

309

| NOZZLE NO. | PULSE WIDTH (μs) |
|---|---|
| 1 | |
| 2 | |
| ⋮ | |
| 1027 | |
| 1028 | |

FIG. 13B

| NOZZLE NO. | LIGHT-SHIELDING TIME (μs) | DELAY TIME (μs) |
|---|---|---|
| 1 | | |
| 2 | | |
| ⋮ | | |
| 1027 | | |
| 1028 | | |

APPARATUS FOR DETERMINING DISCHARGING STATE OF LIQUID DROPLETS AND METHOD, AND INKJET PRINTER

FIELD OF THE INVENTION

The present invention relates to a technique of determining the discharging state of liquid droplets from a head having a plurality of nozzles for discharging droplets.

BACKGROUND OF THE INVENTION

An example of a technique of optically detecting the discharging state of ink from a printhead is disclosed in, e.g., U.S. Pat. Nos. 5,276,467, 5,350,929, and 5,376,958.

A technique of detecting, at high precision, very small ink droplets discharged from each nozzle of a printhead is disclosed in, e.g., U.S. Pat. No. 5,434,430. In these conventional techniques, an analog signal to be generated by detecting ink discharged from each nozzle is compared with a reference value to determine discharge/non-discharge of ink from the nozzle.

For example, according to U.S. Pat. No. 6,517,183, the peak value (peak to peak) of an analog signal to be obtained by detecting discharged ink is evaluated to determine discharge or non-discharge. A technique of changing a determination threshold in accordance with the type of printhead is disclosed in, e.g., U.S. Pat. Nos. 6,056,386, and 6,419,341.

According to these conventional techniques, the difference between detected results is reduced by changing the determination threshold in accordance with the characteristic difference in droplet size, ink color, or a type of printhead, or performing ink discharge for compensating for such difference. Each conventional method essentially employs a detection method having a threshold fixed for each condition.

The principal object of these conventional techniques is to determine discharge/non-discharge of ink, e.g., whether ink (droplet) has been discharged from each nozzle or not. The precision of determining whether appropriate discharge has been done for each nozzle of a printhead is low. In other words, even in the use of a technique of correcting the detection error due to droplet size or ink color, the conventional techniques can attain a precision only enough to prevent misjudgment of discharge/non-discharge from nozzles by a detection mechanism or circuit in consideration of variations in ink-jet printer apparatus, printhead (ink-jet head), ink, environment, or the like.

In recent years, the resolution of an ink-jet printer has increased more and more, and higher-quality image printing is required. In this situation, determination of the ink discharge from each nozzle is not merely determination of discharge/non-discharge. It is necessary to determine whether proper ink discharge related to the quality of a printed image has been done, and feed back the determination result to an ink-jet printer apparatus.

SUMMARY OF THE INVENTION

The present invention has been made in consideration of the above situation, and has as its feature to detect the discharging state of liquid droplets from each nozzle of a printhead and determine non-defectiveness/defectiveness of the nozzle at high precision on the basis of the detection result.

According to the present invention, there is provided a method for determining discharging state from each nozzle of a head which discharges liquid droplets, comprises: a driving step of driving each of nozzles of the head to discharge liquid droplets; a storage step of detecting a discharging state from each nozzle driven in the driving step and storing the discharging state as a physical amount in a memory; a calculation step of calculating a threshold for determining whether the discharging state from each of nozzles of the head is normal or abnormal, on the basis of the physical amount corresponding to each nozzle and stored in the memory; and a determination step of determining whether the discharging state from each nozzle is normal or abnormal, on the basis of the threshold calculated in the calculation step and the physical amount corresponding to the nozzle.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIGS. 13A and 13B depict tables for explaining an example of storing the physical amount of each nozzle in a memory according to the embodiment of the present invention.

DETAILED DESCRIPTION OF THE PREFERRED EMBODIMENTS

Preferred embodiments of the present invention will be described in detail below with reference to the accompanying drawings.

Figure 1:
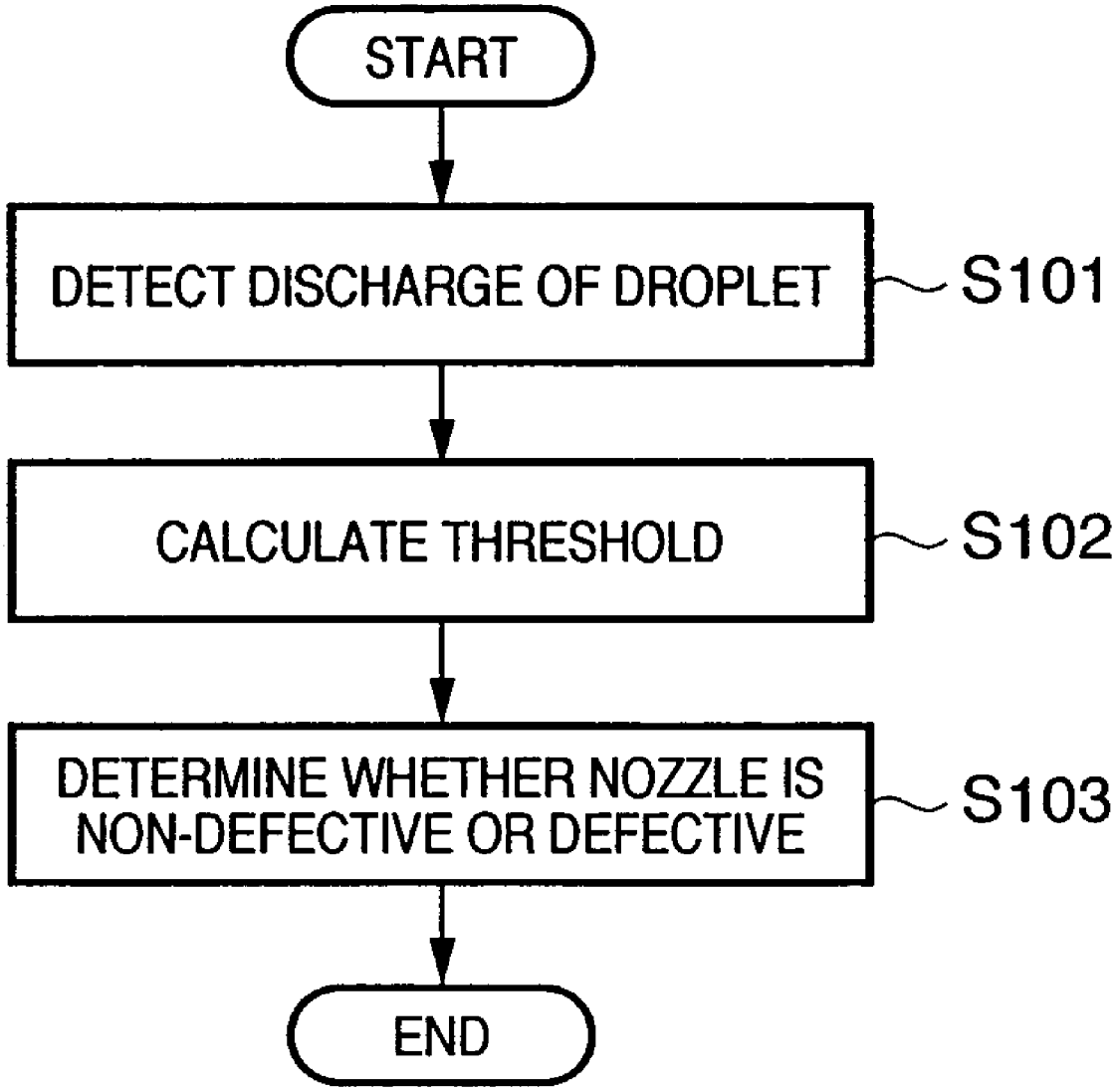
FIG. 1 is a flow chart for explaining determination processing of normality/abnormality of discharge from a nozzle according to the first embodiment of the present invention.

FIG. 1 is a flow chart for explaining processing of determining whether each nozzle of a head (printhead) is non-defective (normal) or defective (abnormal) according to the first embodiment of the present invention. The head in this embodiment can be any type of head which discharges a liquid droplet from each nozzle of the head for a given purpose, such as an ink-jet printhead which discharges ink or a head which discharges a liquid such as a chemical. The first embodiment will exemplify an ink-jet printhead, but the present invention is not limited to this. Processing shown in the flow chart is executed by a CPU 308 in FIG. 3, and a control program for executing this processing is stored in a program memory 310.

In FIG. 1, step S101 is a step of performing driving each one nozzle of a printhead so as to discharge liquid droplet, storing for each nozzle the physical amount (signal level, signal width, the number of signals, signal generation timing, or the like) of a detection signal obtained by a detection means for detecting the discharging state of liquid droplet from each nozzle into a memory, and repeatedly executing this operation until all nozzles of the printhead have been examined. Step S102 is a step of statistically evaluating the physical amount which is detected and stored in the memory, and calculating a threshold for determining whether discharge of liquid droplet from each nozzle is normal or abnormal. Step S103 is a step of evaluating the physical amount of each nozzle that has already been stored in the memory, by using the calculated threshold, and determining whether the liquid discharging state of the nozzle is normal or abnormal.

The first embodiment will be explained in detail, but the present invention is not limited to the arrangement of the first embodiment.

Figure 2:
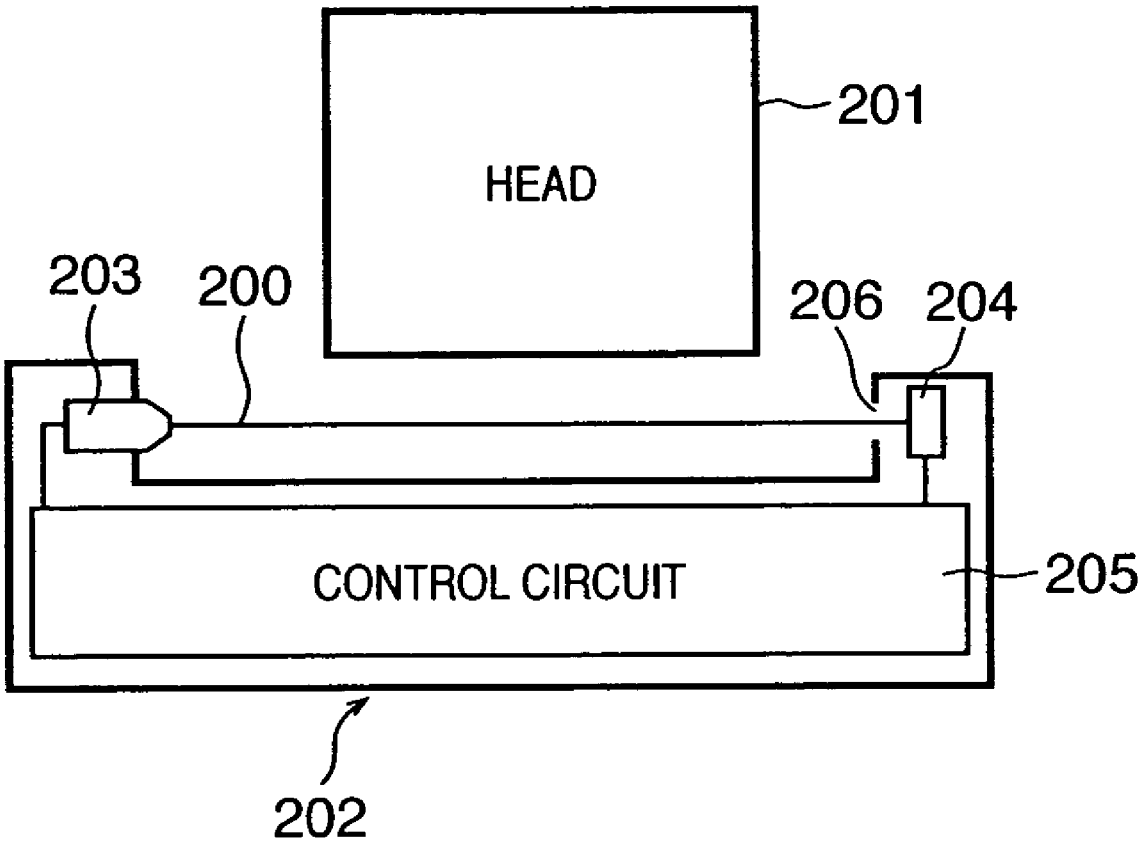
FIG. 2 depicts a view for explaining the positional relationship between a head and a discharging state detection means according to the first embodiment.

FIG. 2 depicts a view for explaining the positional relationship between a printhead 201 and a discharging state detection means 202. As the basic principle, in FIG. 2, droplets are discharged from the printhead 201 to an optical discharging detection means to detect small fluctuations in light quantity when the droplets pass across a beam (flux of light) 200 formed in the optical discharging detection means.

The printhead 201 is, e.g., an ink-jet printhead, and comprises four nozzle arrays, details of which are not illustrated. The nozzle arrays discharge inks in different colors: black, cyan, magenta, and yellow, respectively. Each nozzle array has 1,280 nozzles which are arrayed not in a simple line but in a staggered shape. Nozzles are sequentially numbered from one end of each nozzle array, classifying them into two, odd- and even-numbered lines. These lines will be called odd- and even-numbered nozzle lines. Each of the odd- and even-numbered nozzle lines is, therefore, formed by 640 nozzles, and the interval between the odd- and even-numbered nozzle lines is about 0.3 mm. The nozzle interval in the odd- and even-numbered nozzle lines of each nozzle array is 600 dpi (dots/inch). The odd- and even-numbered nozzle lines are combined to achieve a printing resolution of 1,200 dpi.

The discharging state detection means 202 comprises an LED 203 serving as a light-emitting element (light-emitting source), a photodiode (photo-detector) 204 for detecting light from the LED 203 via an aperture 206, and a control circuit 205. In general, the shape of the aperture 206 is so set as to restrict the light-receiving surface of the photodiode 204. In the first embodiment, however, the light-receiving surface is not restricted by setting the light-receiving surface of the photodiode 204 to 2 mm×2 mm and the aperture 206 to 3 mm×3 mm. With this arrangement, the relative positional precision between the nozzle array of the printhead 201 and the discharging state detection means 202 need not be increased. In this case, the S/N ratio may decrease in a liquid droplet detection signal processing step to be described later, but it can be corrected by the first embodiment. The aperture 206 prevents mixture of stray light, and inflow or attachment of ink mist to the light-receiving portion of the photodiode 204.

In the first embodiment, when the interval between the LED 203 and the photodiode 204 is 40 mm to 60 mm, an effective beam 200 having a width of about 1.5 mm can be obtained near the center between the LED 203 and the photodiode 204 depending on the detecting position and the interval between the LED 203 and the photodiode 204. The width of the beam 200 is smaller than the width and height (2 mm) of the light-receiving surface of the photodiode 204, because the light-emitting area of the effective light source of the LED 203 is smaller than the light-receiving surface of the photodiode 204 and the width of the beam 200 is dominated by the light-emitting area.

The positional relationship between the head 201 and the discharging detection means 202 is held such that the nozzle array of the printhead 201 falls within the beam 200 which is formed between the LED 203 and photodiode 204 when the printhead 201 and discharging detection means 202 are viewed from the flying direction of liquid droplets discharged from the printhead 201. As described above, each nozzle array is comprised of two, odd- and even-numbered nozzle lines spaced apart from each other accurately by about 0.3 mm. The center between the two nozzle lines coincides with the center of the beam 200. As described above, the width of the beam 200 is about 1.5 mm, and the discharging states of the odd- and even-numbered nozzle lines can be detected with the fixed arrangement.

If the center of the beam 200 is defined as an optical axis, the direction of each nozzle array and the optical axis are parallel to each other, and their interval is 2 mm to 4 mm. For a shorter distance between the nozzle array and the optical axis, discharged liquid droplet can be stably detected to increase the reliability of a detection signal. In this case, however, the head 201 itself overlaps a part of the beam 200 to cut off the beam 200. If the relative positional relationship between the head 201 and the discharging state detection means 202 varies by, e.g., vibrations, the variation is superposed as noise on a detection signal, failing in accurate detection.

In the first embodiment, discharge of droplets from the printhead 201 is detected while the relative positions of the printhead 201 and discharging detection means 202 are fixed. There is also proposed a technique of detecting discharged droplet while moving the printhead 201 with respect to the discharging detection means 202 in a direction perpendicular to the nozzle array direction. When this technique is employed, an influence more than simple vibration application is generated, and may become an important factor which determines the distance between the nozzle array and the optical axis.

When the nozzle array of the printhead 201 and the optical axis are arranged at an interval, the printhead 201 is sufficiently spaced apart from the beam 200, preventing superposition of noise on a detection signal caused by vibrations of the printhead 201. However, the precision of discharging state detection may decrease to decrease the S/N ratio, and it may become difficult to accurately determine discharge/non-discharge of droplets. However, by setting an interval, the level difference in detection signal waveform between a nozzle which normally discharges liquid droplets and a nozzle which abnormally discharges liquid droplets becomes clear because of the following reasons. For example, as for the droplet flying direction, liquid droplets from a nozzle which abnormally discharges droplets deviate from the beam 200 for detecting droplets, compared to a nozzle which normally discharges liquid droplets. As for the droplet flying energy, some of liquid droplets from a nozzle which abnormally discharges droplets disperse before the droplets enter the beam 200 for detecting them, compared to a nozzle which normally discharges droplets.

According to the gist of the first embodiment, it is important to detect by an analog signal whether the droplet discharging state is normal or abnormal. The significance of employing the arrangement with low droplet discharge/non-discharge determination precision in which the nozzle array and optical axis are arranged at an interval spaced apart from each other will be understood.

In the first embodiment, the distance between the LED 203 and the photodiode 204 is set about double the nozzle array length of the head 201, e.g., to 40 mm to 60 mm, as described above. The center between the LED 203 and the photodiode 204 and the center of the nozzle array substantially coincide with each other when viewed from the liquid droplet flying direction. Factors which determine these relative positional relationships are as follows.

As for the distance between the LED 203 and the photodiode 204, as the distance shortens, an optical efficiency increases. Even if the LED 203 is driven with a smaller current, a satisfactory light quantity can be ensured. Giving attention to the detection characteristic, the sensitivity decreases in detecting droplets from a nozzle near the LED 203 in a nozzle array to be detected because a part of light cut off by droplets does not enter the light-receiving surface of the photodiode 204 owing to diffraction. In general, light emitted by the LED 203 is divergent light, the surface density of energy of the light decreases as light comes close to the photodiode 204, and thus the sensitivity in detecting droplets from a nozzle near the photodiode 204 decreases depending on the spatial energy distribution characteristic of the LED 203. From this, to obtain an almost uniform detection sensitivity from a nozzle near the LED 203 to a nozzle near the photodiode 204, it is preferable to set the distance between the LED 203 and the photodiode 204 to be much longer than the nozzle array length, and make the center of the optical axis almost coincide with the center of the nozzle array in the optical axis direction. Note that the relative positions of the centers of the optical axis and nozzle array depend on the spatial energy distribution of light emitted by the LED 203, and individually have optimal values. Studies by the present inventors show that a nozzle array is often preferably arranged slightly close to the photodiode 204.

In general, the nozzle array of the printhead 201 is arranged at a distance of 5 mm or more from the periphery of the printhead 201 for structural convenience. When the distance between the LED 203 and the photodiode 204 is made long, they can sandwich the printhead 201. This increases the degree of freedom in a direction in which the distance between the nozzle array and the optical axis is shortened. If the distance between the LED 203 and the photodiode 204 is set not so long enough to sandwich the printhead 201, a distance dominated by the element shapes of the LED 203 and photodiode 204 must be ensured between the surface of the head 201 and the optical axis, decreasing the degree of freedom in a direction in which the distance between the nozzle array and the optical axis is shortened. An optical component which deflects a beam may be newly added to shorten the interval between the nozzle array and the optical axis, which results in high cost.

As described above, the relative positions of the LED 203, the photodiode 204, and the nozzle array of the printhead 201 are determined in consideration of the reliability of a detection signal in addition to their attachment and the like.

Figure 3:
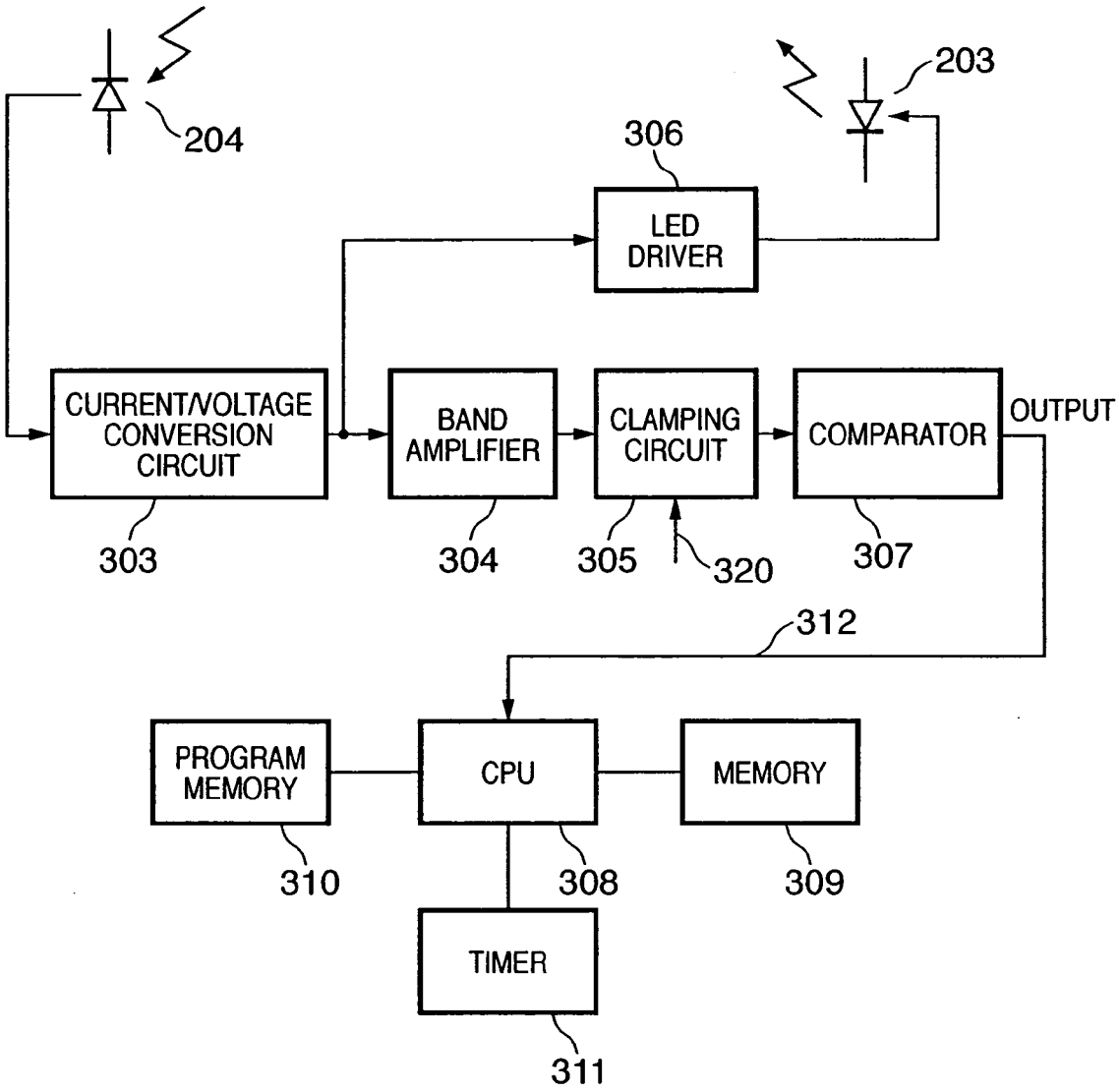
FIG. 3 is a block diagram showing the arrangement of a control circuit of the discharging state detection means according to the first embodiment.

FIG. 3 is a block diagram showing an arrangement of the control circuit 205 according to the first embodiment. For descriptive convenience, the LED 203 and photodiode 204 are also illustrated in FIG. 3.

In FIG. 3, reference numeral 303 denotes a current/voltage conversion circuit which converts a current value flowing through the photodiode 204 into a voltage signal, and outputs the voltage signal. Reference numeral 304 denotes a band amplifier which amplifies the voltage signal output from the current/voltage conversion circuit 303. Reference numeral 305 denotes a clamping circuit which clamps the voltage signal amplified by the band amplifier 304. Reference numeral 306 denotes an LED driver for driving an LED 203. Reference numeral 307 denotes a comparator. A CPU 308 operates in accordance with a control program stored in a program memory 310. A memory 309 stores a digital signal (physical amount) 312 output from the comparator 307 in correspondence with each nozzle. Reference numeral 311 denotes a timer which measures a pulse width of the digital signal 312 from the comparator 307 under the control of the CPU 308, and measures a time until the digital signal 312 changes to high level after an output timing (nozzle driving timing) of a control signal 320.

The LED 203 is driven to emit light, and a current proportional to the incident light quantity is output from the photodiode 204. The current is converted into a voltage signal by the current/voltage conversion circuit 303. The voltage signal is fed back to the LED driver 306, and the emission amount of the LED 203 is automatically controlled to a predetermined amount.

Small fluctuations in light quantity when liquid droplets cut off the beam 200 from the LED 203 are converted into a voltage signal by the current/voltage conversion circuit 303, and the voltage signal is amplified by the band amplifier 304. The amplified voltage signal is input to the comparator 307 via the clamping circuit 305.

The operation of the clamping circuit 305 will be explained.

A signal level output from the band amplifier 304 immediately before discharged droplet is observed, is clamped at a predetermined value by the control signal 320 which is synchronized with discharge of the liquid droplet. Clamping operation is canceled immediately before droplets are discharged and start to cut off the beam 200. Even if, e.g., low-frequency disturbance light is mixed, its influence can be removed by the clamping circuit 305, and the detection signal (voltage signal) can be evaluated by a fixed reference value (reference voltage). Low-frequency disturbance or the like can also be suppressed by the effect of the band amplifier 304, but this arrangement is not optimal in consideration of the necessity of an idle period for removing DC-level fluctuations of the detection signal itself. For this reason, the clamping circuit 305 is provided.

The comparator 307 compares an output from the clamping circuit 305 with a predetermined level (reference voltage), and outputs the comparison result as the digital signal 312. A period (high-level period in the first embodiment) during which a decrease in light quantity by cutting off a part of the beam 200 by discharged droplets is a predetermined amount or more, can be obtained by a change in the digital signal 312.

These circuits can be relatively downsized and mounted. For example, when the discharging detection means 202 is formed into a unit, the unit is almost free from the influence of mixture of noise in an electrical signal because the interface between this unit and a circuit which controls the unit is digitized. If a system which evaluates an analog detection signal by using an A/D converter is introduced, the clamping circuit 305 and comparator 307 can be omitted. An output from the band amplifier 304 is directly input to the AID converter and digitized into multilevel data, and then, for example, the peak value (peak to peak) of the detection signal is evaluated. In general, it is difficult to form a unit including an AID converter. In this arrangement, an analog signal remains between the unit and the unit control circuit, and the unit is readily influenced by noise. In any case, the first embodiment obtains the digital signal 312 by using the comparator 307.

The band-pass of the band amplifier 304 will be explained.

A high-frequency band is limited to a range in which the S/N ratio of a voltage signal serving as a detection signal is satisfactorily ensured on the assumption that the voltage value of a detected signal is basically evaluated. This is because an unnecessarily large band increases noise of the current/voltage conversion circuit 303 and band amplifier 304, decreasing the S/N ratio in voltage detection. A low-frequency band is preferably limited slightly high within a range in which the detection signal level of an output from the band amplifier 304 does not greatly decrease, so as to observe a slight differential characteristic in order to eliminate the influence of vibrations. The automatic light quantity adjustment mechanism of the LED 203 using the above-mentioned feedback operation limits a low-frequency band, and the frequency response characteristic of the LED driver 306 must be considered in optimizing the entire frequency pass characteristic.

Discharge control of liquid droplets from the printhead 201 will be explained.

Under the present circumstances in which the amount of discharged droplet from the printhead 201 becomes smaller, it is very difficult to obtain a desired S/N ratio by detection of discharged droplet actually accompanying one driving for discharge, in order to determine whether each nozzle is non-defective or defective. To realize such S/N ratio, the beam 200 may be narrowed down by the aperture 206 to increase the contrast when droplets cut off the beam. In this case, the required precision of the relative positional relationship between the discharging detection means 202 and the nozzle array becomes undesirably strict. The change of the aperture 206 may not attain necessary sensitivity, and a complicated optical component must be combined with the LED 203, or the light source must be changed to a laser, resulting in high cost. To avoid this, the first embodiment employs a method using a signal obtained by driving a plurality of number of times a nozzle to be inspected and superposing detection signals respectively corresponding to a plurality of driving operations. The first embodiment adopts a sequence of executing discharge driving successively five times in a cycle of 67 μsec, setting an idle period corresponding to 10 discharge driving operations, and then performing discharging detection processing for the next nozzle to be inspected. The upper limit of the band of the band amplifier 304 is so set as to ensure an optimal S/N ratio in discharge.

The pulse width of the digital signal 312 output from the comparator 307 is measured by the timer 311. The polarity of the comparator 307 is inverted, and while droplets cut off the beam 200, the digital signal 312 is output at high level, and the time while the signal 312 being high level is measured by the timer 311. Measurement operation is performed at every inspection of discharge state from each nozzle, and a measurement value (droplet detection time) corresponding to each nozzle is stored in the memory 309 of the control circuit 205 in correspondence with the nozzle.

A comparison with the prior art will be explained to clarify the difference from the prior art. In the prior art, the size of a discharged droplet is large, and discharge/non-discharge from a nozzle cannot be directly determined by an output from the comparator. For example, a nozzle is determined to discharge droplets when the comparator 307 outputs a high-level pulse. As a developed version of this method, the pulse width is evaluated, and if the pulse width is equal to or larger than a predetermined value, the nozzle is determined to discharge droplets. These methods are based on a predetermined reference value. To the contrary, the first embodiment requires an arrangement in which the time while the detected signal 312 being high level (time during which discharged droplet is detected) is measured and stored in the memory 309.

The outline of the first embodiment has been described. Essential operation according to the first embodiment will be explained.

Figure 4:
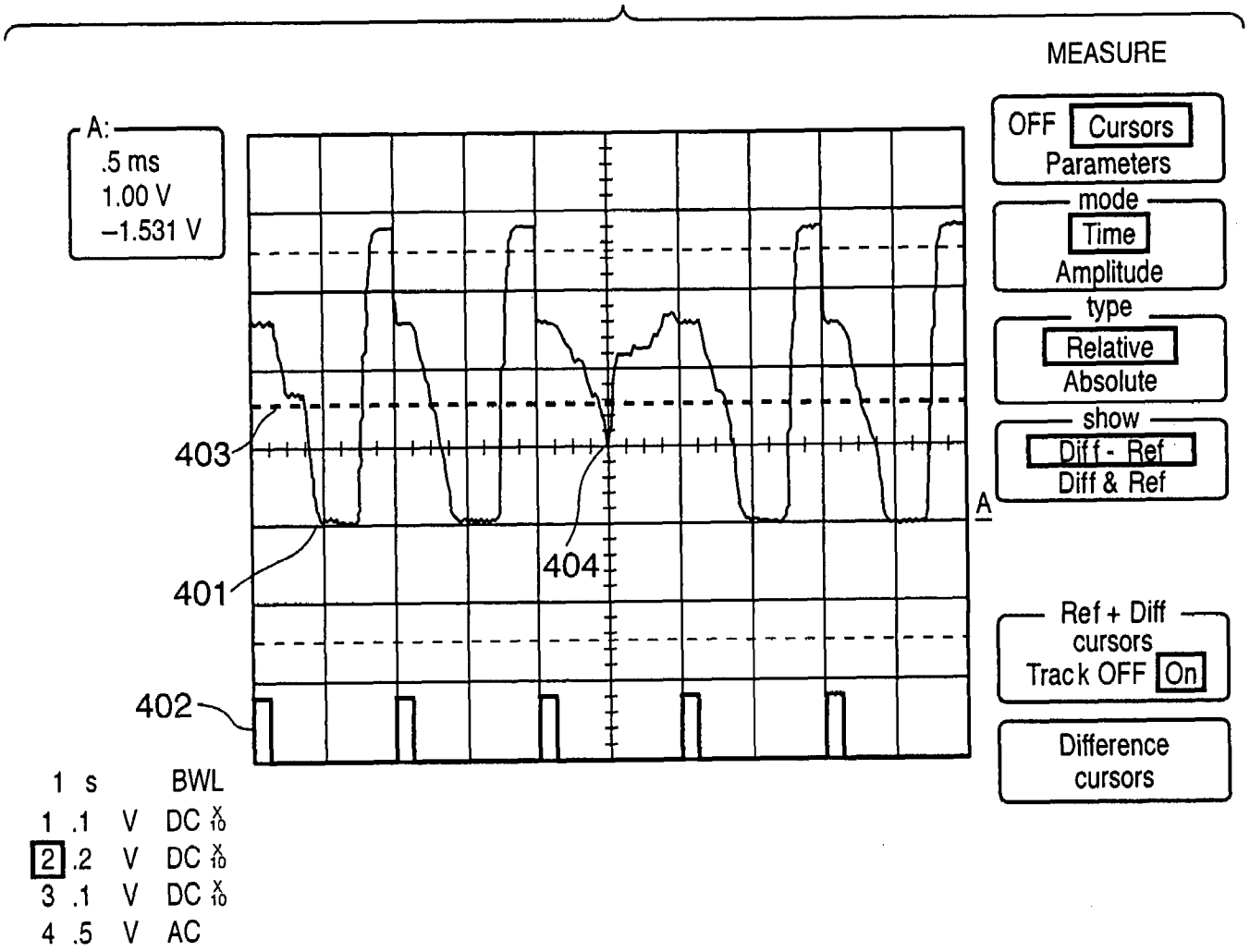
FIG. 4 depicts a waveform chart showing an example of the waveform of a voltage signal (detection signal) detected by the discharging state detection means according to the first embodiment.

FIG. 4 shows a waveform chart showing an example of the waveform of a discharging detection signal (voltage signal) according to the first embodiment.

In FIG. 4, the waveform of a signal 401 is represented by an analog signal output from the clamping circuit 305 before input to the comparator 307. In practice, discharges from all the nozzles (in this case, 1,280 nozzles) of the printhead 201 are inspected. FIG. 4 shows extracted part of this inspection.

In FIG. 4, the signal 401 represents the waveform of a voltage signal output from the clamping circuit 305. Reference numeral 402 denotes a waveform of the control signal 320 input to the clamping circuit 305. Reference numeral 403 denotes a reference voltage level of the comparator 307. Reference numeral 404 denotes a voltage signal in a nozzle which is recognized to perform abnormal discharge in actual printing using the nozzle. In the first embodiment, the control signal 320 of the clamping circuit 305 is given by a pulse signal having a cycle of 1 msec, as shown 402. The comparator 307 has an inverting polarity, and when the voltage signal 401 becomes equal to or lower than the reference voltage 403, outputs a high-level signal. In FIG. 4, each waveform at which the voltage signal 401 is equal to or lower than the reference voltage 403 corresponds to the waveform of the detection signal of each nozzle. The voltage signal of each nozzle is a signal as a result of executing discharge driving successively five times in a cycle of 67 μsec and setting an idle period corresponding to 10 discharge driving operations. The abnormal discharge signal waveform 404 represents an example of the detection signal of each nozzle.

The operation will be further explained by giving attention to the waveform of the detection signal of each nozzle.

Since the flying speed of droplets discharged from each nozzle is about 10 m/sec, droplets require about 150 μsec to pass through the 1.5 mm width of the beam 200. Assuming that the band of the band amplifier 304 is not completely limited, the signal waveform obtained by five successive discharge driving operations in a cycle of 67 μsec is a waveform of about 500 μsec as a total width with five oscillations in a cycle of 67 μsec for a beam having a Gaussian energy distribution. Considering only the high-frequency cutoff characteristic of the band amplifier 304, the impulse response has a width of about 200 μsec. With this effect, the peak and bottom of the 67-μsec cycle can be suppressed, but the total width is increased to about 700 μsec. Considering the low-frequency cutoff characteristic of the band amplifier 304, the cutoff frequency is set to 330 Hz, and the waveform greatly rises about 500 μsec after the waveform of the voltage signal 401 starts dropping. This phenomenon is exhibited by the voltage signal 401 in FIG. 4 with this mechanism without any contradiction. A portion at which the lower limit of the voltage signal 401 is clipped, is generated by the limitation of the dynamic range of the circuit.

In step S101 of FIG. 1, a time value (pulse width) corresponding to a time during which the voltage signal 401 becomes lower than the reference voltage 403 is stored in the memory 309 for each discharge driving signal to each nozzle. The number of nozzles of the printhead 201 is 1,280, and a total of 1,280 time values are stored.

FIG. 13A depicts a table for explaining a data structure for storing in the memory 309 the pulse width (μsec) of each of the 1,028 nozzles of the head 201. The physical amount of the detection signal of each nozzle that is stored in the memory 309 may be a signal level, signal width, the number of signals, or signal generation timing as described above.

Figure 5:
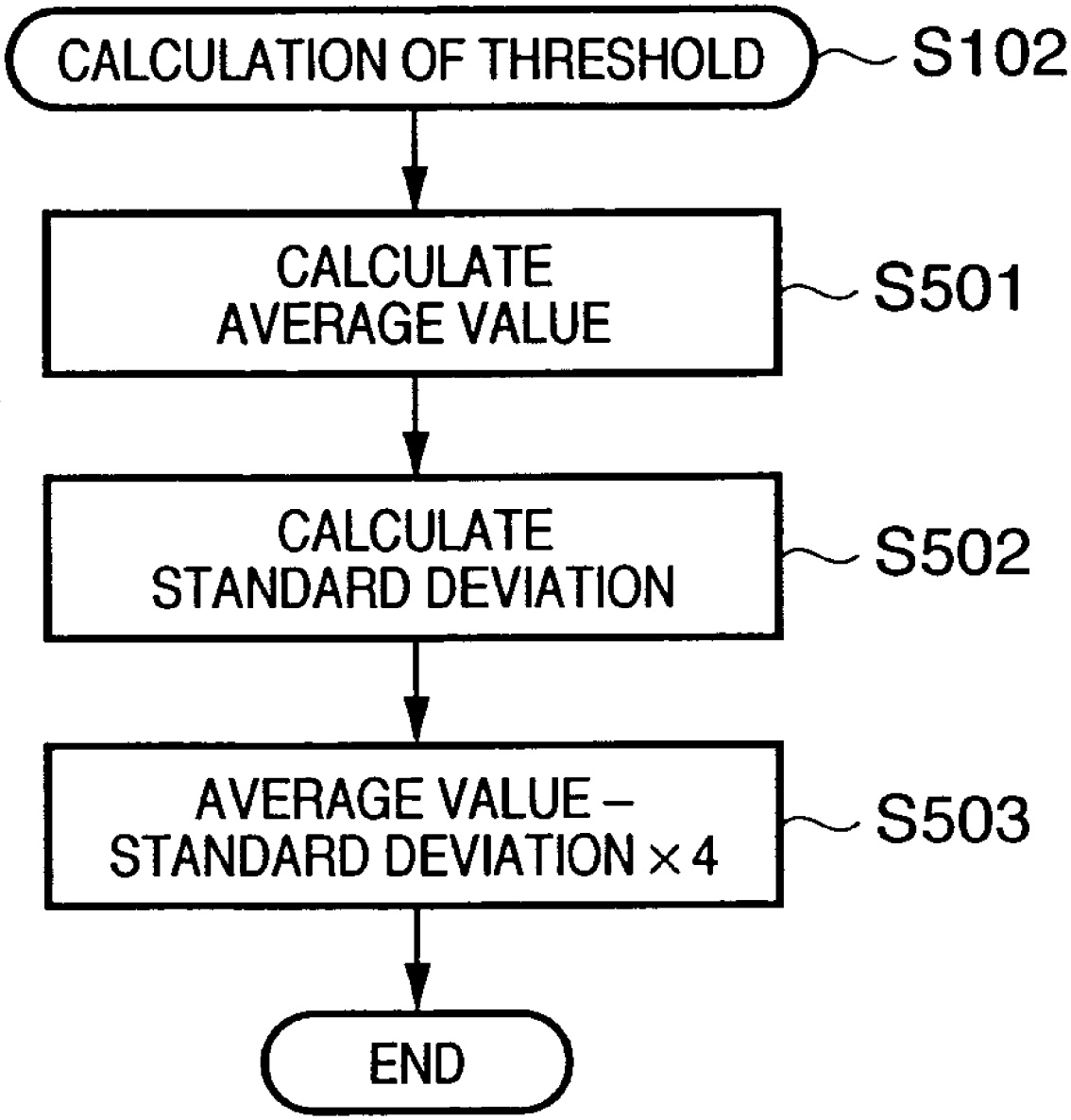
FIG. 5 is a flow chart showing a detailed sequence of threshold calculation processing in step S102 (FIG. 1) according to the first embodiment.

FIG. 5 is a flow chart showing in detail a calculation processing sequence in step S102 of FIG. 1. A program which executes this processing is stored in the program memory 310.

In step S501, the average value of time values corresponding to the 1,280 nozzles is calculated. The processing advances to step S502 to calculate a standard deviation σ between these time values. The processing advances to step S503 to calculate (average value−standard deviation σ×4) and set the result as a lower threshold.

In step S103 of FIG. 1, a nozzle corresponding to a time value lower than the threshold is specified on the basis of the threshold calculated in step S102 (S503), and determined as a "defective discharge nozzle".

The first embodiment of the present invention has been described. According to studies by the present inventors, the average value was 480 μsec and the standard deviation was 45 μsec as a result of sampling time values based on the voltage signal 401, as shown in FIG. 4. A nozzle corresponding to the waveform 404 in FIG. 4 could be determined as a "defective discharge nozzle" on the basis of the threshold (in this case, 300 μsec).

The above description will be summarized. In the prior art, it is determined whether discharging state from each nozzle is normal or abnormal by a basically fixed threshold. For this reason, the apparatus difference, individual difference, and environmental difference in detection cannot be compensated for, and high precision cannot be obtained in determination of discharging state normality/abnormality for high-quality image printing. To the contrary, the first embodiment gives an attention to the fact that the waveforms of the discharging detection signals of non-defective nozzles are similar to each other and that the ratio at which a defective nozzle is mixed is low in detecting a normal droplet discharging state. A threshold for determining whether discharging state from each nozzle is normal or abnormal, is determined from discharging detection signals detected at all the nozzles of the printhead. Hence, a "defective discharge nozzle" can be determined at high precision without any influence of variations in the amounts of discharged droplet from nozzles.

Several supplemental remarks on the first embodiment will be given. The first embodiment assumes that the number of defective discharge nozzles is smaller than the total number of nozzles of the printhead. The basic principle is that a nozzle which deviates from the original variation distribution of a normal nozzle is determined as a defective nozzle. Mixture of many defective discharge nozzles results in many errors contained in a calculated threshold. In order to generate a higher-precision threshold, it is preferable to exclude an apparently non-discharge nozzle from inspection targets in advance by separately using a fixed threshold or the like. That is, it is preferable to exclude the discharging detection signal of the excluded nozzle from data for calculating a threshold in step S102.

In step S503 of FIG. 5, the threshold is calculated by {average value−(standard deviation×4)}. The effectiveness of the threshold has been confirmed within a range of three to six multiples of the standard deviation, in addition to four multiples of the standard deviation. In steps S102 and S103 of FIG. 1, the upper limit of the time value is not evaluated, but is preferably added to the determining conditions in consideration of abnormal discharge.

Calculation processing of the standard deviation σ may be omitted, and a predetermined value may be subtracted from an average value to set the difference as a threshold. In this case, square calculation and square-root calculation for obtaining a standard deviation can be omitted to shorten the determination time.

A predetermined value may be subtracted from the median of discharging detection signals detected for all nozzles of the printhead to set the difference as a threshold. In this case, unlike the average value, the influence of the discharging characteristic of a defective nozzle on the threshold can be reduced.

In the first embodiment, the physical amount corresponding to the droplet discharging level is the time width of a digital signal representing the result of a comparison with the reference voltage. Alternatively, an output from the band amplifier 304 may be input to an A/D converter, and the peak value (peak to peak) may be employed as a physical amount corresponding to the droplet discharging level, as described above.

Second Embodiment

Figure 6:
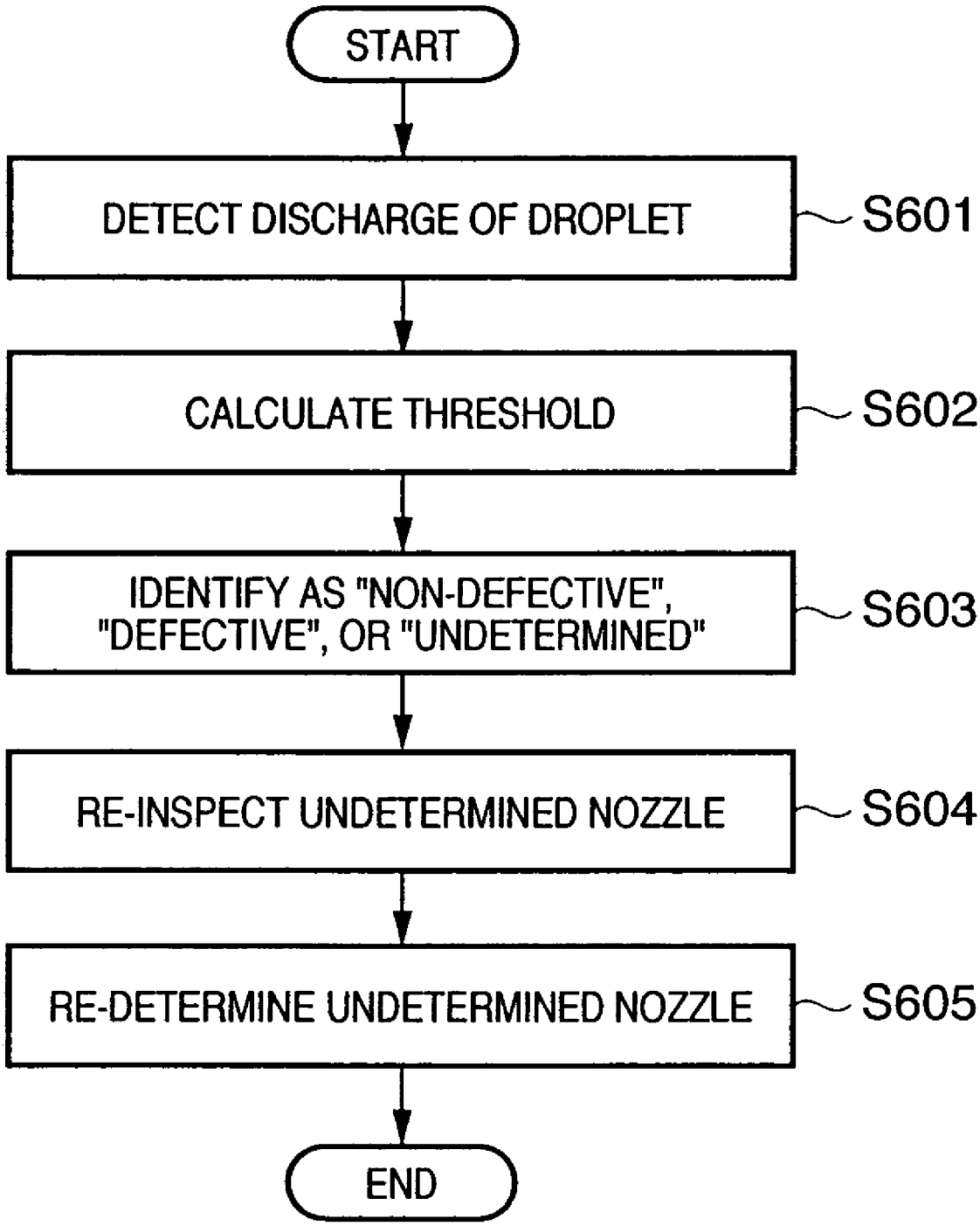
FIG. 6 is a flow chart for explaining determination processing of nozzle in non-defectiveness/defectiveness according to the second embodiment of the present invention.

FIG. 6 is a flow chart for explaining processing according to the second embodiment of the present invention. In the second embodiment, the re-inspection step is added to the first embodiment to further increase the precision of the detection. The hardware arrangement according to the second embodiment is substantially the same as that according to the first embodiment. A program for executing the processing of FIG. 6 is stored in a program memory 310.

In step S601 of FIG. 6, driving for discharging liquid droplet is performed for each nozzle of the printhead 201, and the physical amount (signal level, the number of signals, time width, output timing, or the like) of a detection signal obtained by the discharging detection means 202 for detecting the discharging state of liquid droplets from the nozzle is stored for each nozzle. This operation is repeatedly executed for all nozzles of the printhead 201. This processing corresponds to step S101 of FIG. 1. In step S602, the physical amount which is detected and stored in the memory 309 is statistically evaluated, and a threshold (time value in this case) for determining whether discharge of liquid droplet from each nozzle is normal or abnormal, is calculated.

In step S603, the physical amount of each nozzle that has already been stored in the memory 309 is evaluated using the threshold calculated in step S602, and each nozzle is identified as one of three types "non-defective nozzle", "defective nozzle", and "undetermined nozzle". The processing advances to step S604 to drive a nozzle for discharging liquid droplet again, wherein the nozzle is determined as an "undetermined nozzle" in step S603, and store the physical amount of the detection signal obtained by the discharging state detection means 202 for each "undetermined nozzle". The processing advances to step S605 to finally determine whether the "undetermined nozzle" is non-defective or defective, on the basis of the physical amount detected and stored in step S604.

The operation of each step in FIG. 6 will be explained in detail. Processing in step S601 is the same as step S101 described above, and a description thereof will be omitted. In step S602, two thresholds, i.e., a non-defective nozzle determination threshold and defective nozzle determination threshold are obtained. The non-defective nozzle determination threshold is calculated by the same sequence as step S102 of FIG. 1 described above. The defective nozzle determination threshold is a fixed threshold at which a nozzle is clearly determined as a defective, or a value obtained by widening an allowance for calculating the non-defective nozzle determination threshold. For example, when the non-defective nozzle determination threshold is (average value−standard deviation×3: 345 μsec in the above example), the defective nozzle determination threshold is (average value−standard deviation×6: 210 μsec in the above example). In step S603, the nozzle is identified as one of the three types "non-defective nozzle", "defective nozzle", and "undetermined nozzle" on the basis of the two thresholds calculated in step S602. At this time, a nozzle whose physical amount corresponding to the discharging level is equal to or larger than the non-defective nozzle determination threshold (e.g., 345 μsec) is identified as a "non-defective nozzle"; a nozzle whose physical amount is smaller than the defective nozzle determination threshold (e.g., 210 μsec), as a "defective nozzle"; and a nozzle which does not belong to either nozzle group, as an "undetermined nozzle".

In step S604, for an "undetermined nozzle" among identified nozzles, driving for discharging liquid droplet, sampling of the above-mentioned physical amount and storing it in the memory 309 are executed again. This sequence is the same as step S101 of FIG. 1, and a description thereof will be omitted.

In step S605, it is finally determined whether the re-inspected "undetermined nozzle" is non-defective or defective. As the determination method, the physical amount corresponding to the discharging level is compared with the non-defective nozzle determination threshold (e.g., 300 μsec). If the physical amount is equal to or larger than the threshold, the nozzle is determined as a "non-defective nozzle"; if the physical amount is smaller than the threshold, it is determined as a "defective nozzle".

Since the second embodiment adds the re-inspection step, the possibility of a determination error by noise or disturbance can be reduced. With this effect, the non-defective nozzle determination threshold can be strictly set to increase the degree of precision of discharging state detection.

Several supplemental remarks on the second embodiment will be provided.

For the above-described threshold, not only a lower limit but also an upper limit are preferably set, which can reduce, e.g., the influence of a detection error by mixture of noise. This will be explained briefly. Lower and upper thresholds are set for the non-defective nozzle determination threshold, and a nozzle having a value between the two thresholds is determined as a "non-defective nozzle". Similarly, lower and upper thresholds are set for the defective nozzle determination threshold, and a nozzle not having a value between the two thresholds is determined as a "defective nozzle". The defective nozzle determination threshold is set outside the non-defective nozzle determination threshold.

In step S604, an "undetermined nozzle" may be re-inspected twice or more. In this case, the nozzle may be determined using the average of inspection results. Alternatively, the nozzle may be determined for each inspection and finally determined by majority. Alternatively, dispersion in each inspection may be analyzed, and if the dispersion is equal to or larger than a predetermined value, the nozzle may be determined to be unstable as a "defective nozzle" In any case, whether each nozzle is non-defective or defective is comprehensively determined from a plurality of results, increasing the degree of precision of discharging state detection. Re-inspection is limited to an "undetermined nozzle", and in a normal state in which the number of "undetermined nozzles" is very smaller than the total number of nozzles, the test time becomes shorter than that of a method of testing all nozzles a plurality of number of times.

Third Embodiment

Figure 7:
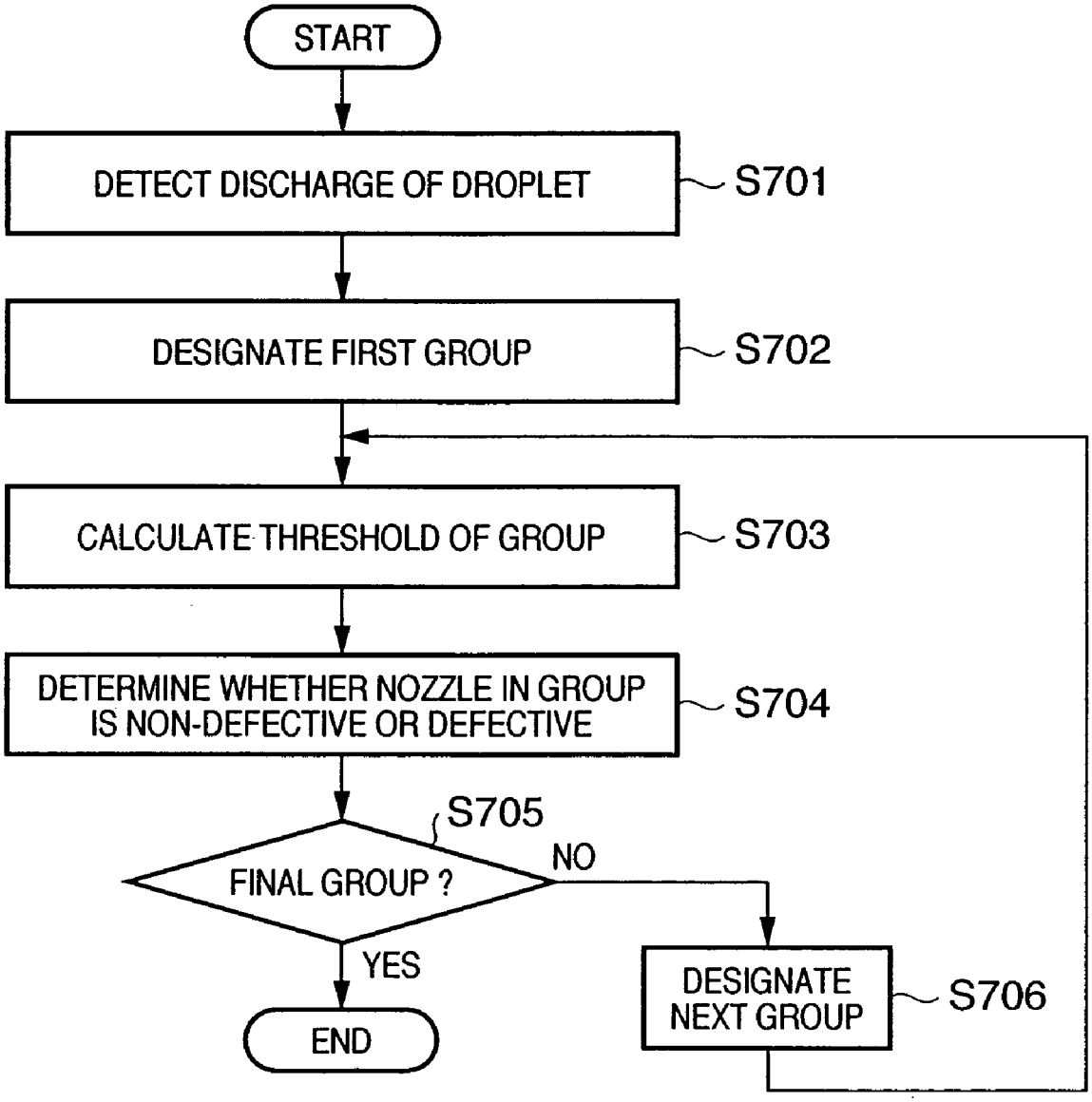
FIG. 7 is a flow chart for explaining determination processing of nozzle in non-defectiveness/defectiveness according to the third embodiment of the present invention.

FIG. 7 is a flow chart for explaining nozzle non-defectiveness/defectiveness determination processing according to the third embodiment of the present invention. A program for executing this processing is stored in a program memory 310. In the third embodiment, unlike the first embodiment, a plurality of adjacent nozzles are grouped, and calculation of a threshold and non-defectiveness/defectiveness determination are done for each group. The third embodiment is based on the finding that, for example, a 1 inch long printhead having 1,280 nozzles at 1,200 dpi suffers a large signal level difference of a detection signal by variations in the ink discharging characteristic of the printhead depending on the nozzle position, and a large signal level difference of a detection signal depending on the position for detection by the optical characteristics of the LED 203 and the photodiode 204. By grouping neighboring nozzles and executing inspection processing for each nozzle group, these level differences can be suppressed to further increase the degree of precision. The hardware arrangement according to the third embodiment is the same as those according to the above embodiments, and a description thereof will be omitted.

In step S701 of FIG. 7, each nozzle of the printhead 201 discharges liquid droplets on the discharging state detection means 202, and the physical amount of a detection signal obtained by the discharging state detection means 202 for the nozzle is stored in the memory 309 in correspondence with the nozzle. This operation is repeatedly executed for all nozzles. This processing corresponds to step S101 of FIG. 1.

In step S702, detected physical amounts are classified into data corresponding to odd- and even-numbered nozzle arrays. The first group of every 20 adjacent nozzles in each group is designated, and a discharging determination threshold is calculated for each group in step S703.

In step S704, the physical amount of each nozzle that is stored in the memory 309 is evaluated for each group by using the calculated threshold of the group, and it is determined whether the droplet discharging state of the nozzle is normal or abnormal. In step S705, it is determined whether processing has ended for all groups of all the nozzles of the printhead 201. If NO in step S705, the processing advances to step S706 to designate to repetitively select the next group and execute the processing. This will be explained in detail.

Processing in step S701 is the same as step S101 described above, and a description thereof will be omitted. In step S702, the first group is selected. In step S703, the average value and standard deviation of the physical amounts (time period (pulse-width) in this case) of 20 nozzles belonging to the group are obtained. (Average value−standard deviation×4) is calculated to obtain a threshold (time value) for determining whether a nozzle belonging to the group is non-defective or defective. In step S704, it is determined whether a target nozzle is non-defective or defective using the threshold of the group to which the nozzle belongs. In step S705, it is determined whether group designation processing and non-defectiveness/defectiveness processing for all the groups have been completed, in order to sequentially execute processes in steps S703 and S704 for all the nozzle groups of the printhead 201.

Several supplemental remarks on processing according to the third embodiment will be provided.

One group is formed by 20 nozzles in the above description, but the present invention is not limited to this. As a result of examining variations between nozzles depending on their positions in detail, the whole nozzles are preferably divided into at least four groups.

Odd- and even-numbered nozzles may be grouped without classification, but are preferably classified to lower the standard requirement of the relative positional precisions of the nozzle array and the discharging state detection means 202.

Nozzles in each group need not be completely adjacent to each other. Neighboring nozzles can provide with the same effect. However, the above-described effect cannot be attained in a case where nozzles from the first nozzle to the 1280th nozzle are classified into, e.g., four groups in a comb-tooth shape. This is because the maximum distance between nozzles belonging to the same group is not shortened by the grouping. It is important to sufficiently shorten the maximum distance (group length) between nozzles belonging to the group by grouping, compared to the distance (interval between nozzles at the two ends of the head) before the grouping.

Each group may share some nozzles belonging to each group. If the capacity of calculation reserves, each group including 10 nozzles on the both sides of the nozzle to be interested is defined, and the number of groups corresponding to the total number of nozzles of the head may be defined. In this case, thresholds are successively calculated for each group to further improve the reliability.

The re-inspection step may be added, similar to the second embodiment.

Fourth Embodiment

Figure 8:
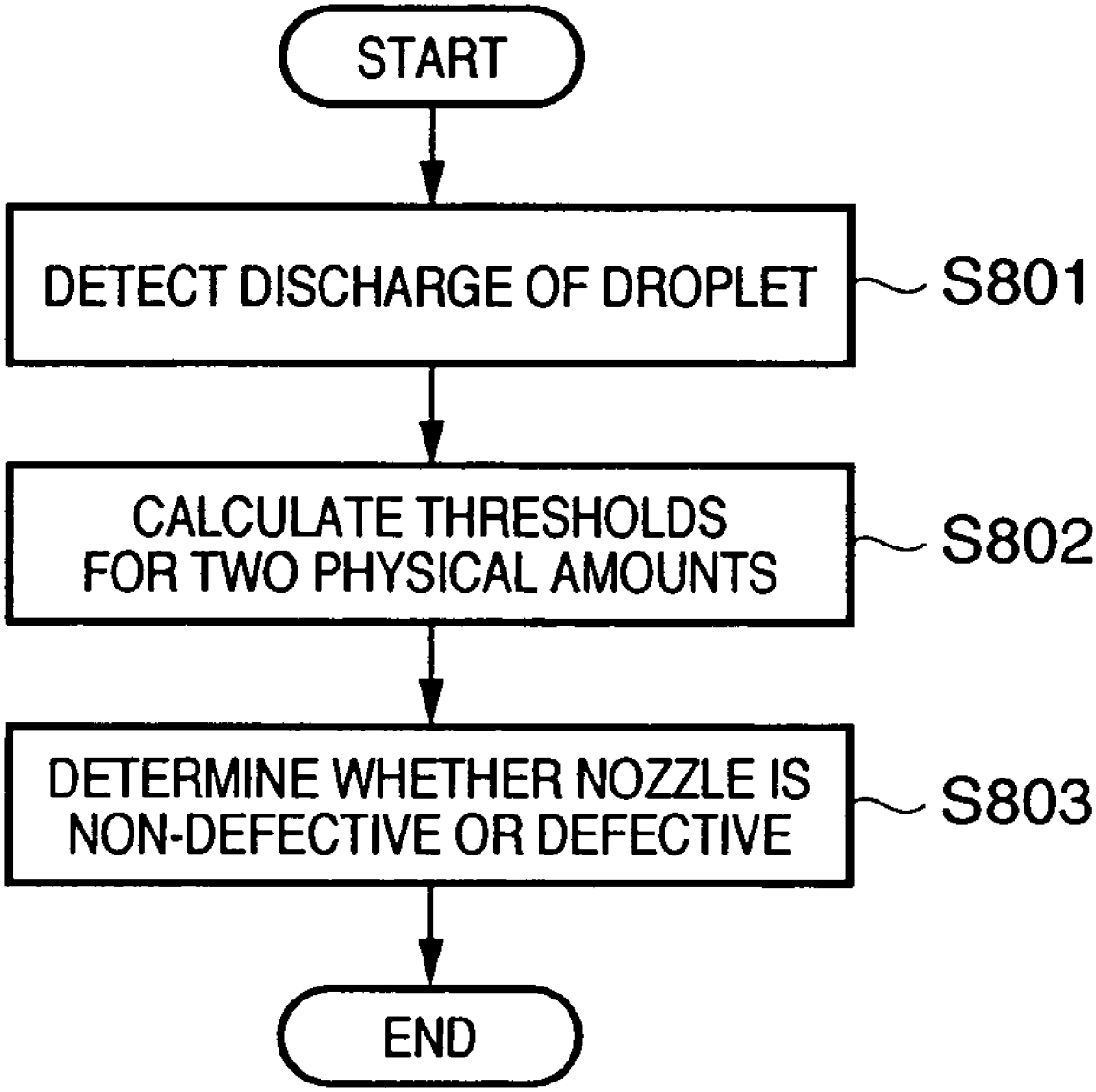
FIG. 8 is a flow chart for explaining determination processing of nozzle in non-defectiveness/defectiveness according to the fourth embodiment of the present invention.

FIG. 8 is a flow chart for explaining nozzle non-defectiveness/defectiveness determination processing according to the fourth embodiment of the present invention. The hardware arrangement according to the fourth embodiment is the same as those according to the above embodiments.

In step S801 of FIG. 8, driving for discharging liquid droplet is performed for each nozzle of the printhead 201 on the discharging state detection means 202. Of detection signals obtained by the discharging state detection means 202, two physical amounts, i.e., a physical amount correlative with the discharging amount and a physical amount correlative with the discharging speed are stored in the memory 309 for each nozzle. This operation is repeatedly executed for all the nozzles. The processing advances to step S802 to statistically evaluate the physical amounts which are detected and stored in the memory 309, and calculate a threshold for determining droplet discharge. The processing advances to step S803 to evaluate the physical amount of each nozzle that is stored in the memory 309 by using the calculated threshold, and determine whether the droplet discharging state is normal or abnormal. In the following description, the droplet discharging speed is also expressed as a droplet flying speed.

Figure 9:
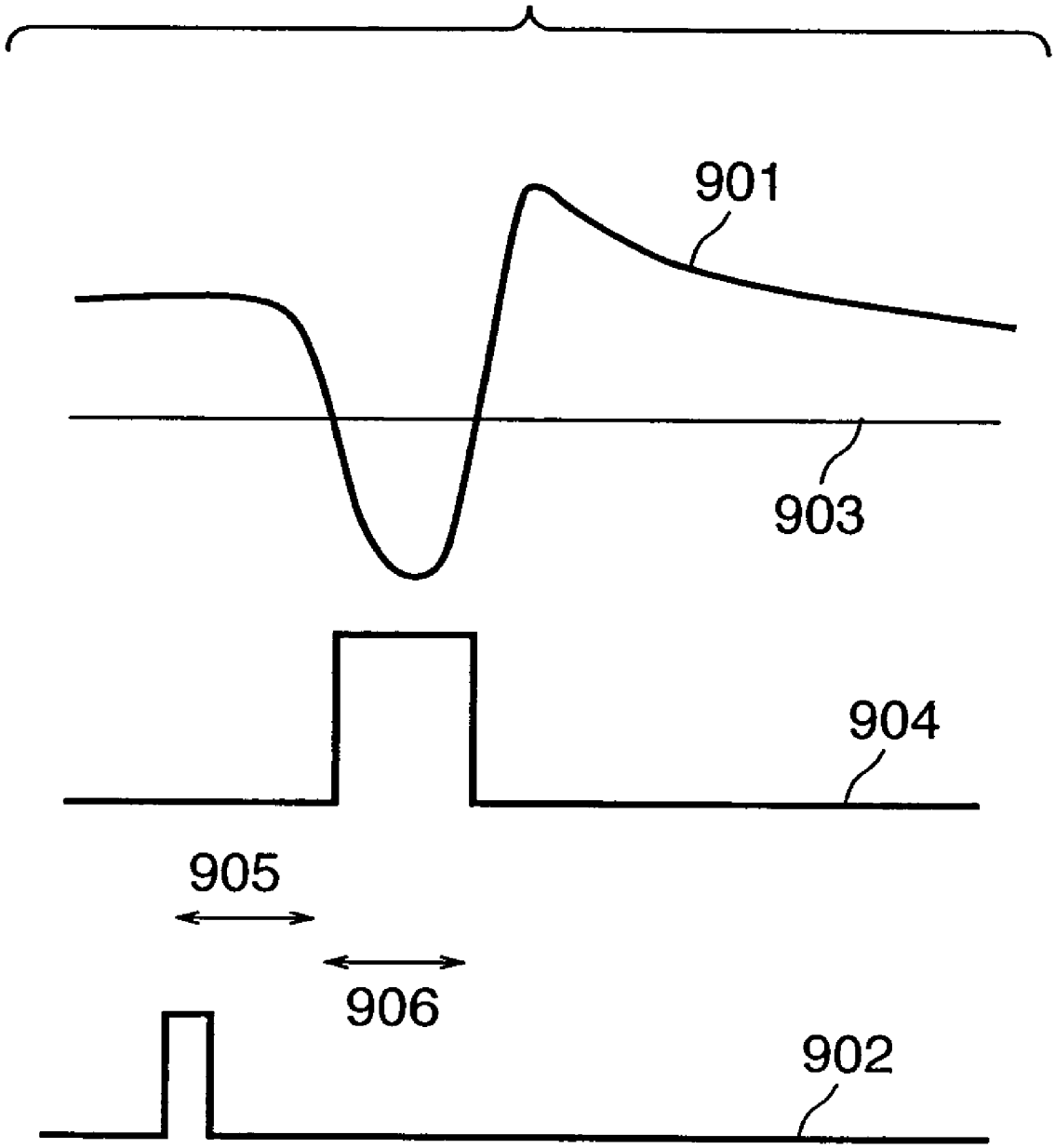
FIG. 9 depicts a waveform chart for explaining in detail a physical amount correlative with the amount of discharged liquid droplet and a physical amount correlative with the discharge speed according to the fourth embodiment.

FIG. 9 is a waveform chart for explaining in detail a physical amount correlative with the droplet discharging amount and a physical amount correlative with the droplet discharging speed.

In FIG. 9, reference numeral 901 denotes a waveform example of a detection signal (voltage signal) for each nozzle. Reference numeral 902 denotes a discharge driving signal representing the timing of driving droplet discharge. Each nozzle is so driven as to discharge droplets in synchronism with the rise of the signal 902. Reference numeral 903 denotes a reference signal level which is compared by the comparator 307; and numeral 904 denotes a comparison result signal which is output as a digital value as a result of a comparison between the detection signal 901 and the reference signal 903 by the comparator 307, and the signal 904 corresponds to the digital signal 312 output from the comparator 307 in FIG. 3.

The comparison result signal 904 is output at high level while the detection signal 901 is smaller than the reference signal 903, i.e., droplets cut off part of the beam 200 from the discharging state detection means 202 at a predetermined level or more. Reference numeral 905 denotes a time which corresponds to a physical amount correlative with the discharge speed, and will be called a delay time until discharged droplet is detected after a nozzle is driven to discharge. Reference numeral 906 denotes a discharging time (time during which discharge of droplet is detected) which corresponds to a physical amount correlative with the discharging amount, and will be called a light-shielding time. When the flying speed of droplet becomes lower, the time until the droplet reach the discharging state detection means 202 after driving the nozzle of the head 201 becomes longer, resulting in a long delay time 905. From this, the delay time 905 is apparently a physical amount correlative with the flying speed of droplet.

If the droplet discharging amount decreases from the state shown in FIG. 9, the time period at which the level of the signal 901 becomes equal to or lower than the reference signal 903 decreases. The amplitude of the comparison result signal 904 decreases, and the light-shielding time 906 is shortened. Thus, the light-shielding time 906 is apparently a physical amount correlative with the droplet discharging amount. The delay time 905 and light-shielding time 906 are measured by corresponding timer means (timer 311), and stored in the memory 309 in correspondence with each nozzle.

FIG. 13B depicts a table for explaining a data structure stored in the memory 309.

Exactly speaking, the light-shielding time 906 and delay time 905 are not completely independent physical amounts. For example, if the droplet discharging amount decreases, the delay time 905 increases without any change in flying speed. This phenomenon will be easily understood by those skilled in the art similarly to a case wherein a gain of the band amplifier 304 is increased/decreased. To correct this phenomenon, appropriate calculation may be done between the delay time 905 and the light-shielding time 906 to newly define a parameter as an effective delay time. Considering the purpose of the fourth embodiment, the two physical amounts need not be completely independent. This is because these physical amounts exhibit similar values with small variations between neighboring nozzles as far as the nozzles are non-defective.

The reason that the present inventors have given an attention not only to the droplet discharging amount but also to the flying speed will be explained.

The droplet discharging amount is sufficient for determining only discharge/non-discharge of droplets from each nozzle. However, to determine whether the nozzle is non-defective for high-quality printing, the flying speed of droplet is important in a recent, high-density, multi-nozzle head. As a simple example, assume that the flying speed from only a specific nozzle decreases. In this case, an ink-jet printer having a printhead prints on the assumption that all nozzles of the printhead have the same flying speed of droplet. A dot printed by ink from the specific nozzle may cause a landing shift, decreasing the image quality.

The present inventors grasp the fact that a nozzle whose flying speed is lower than that of another nozzle does not greatly decrease in droplet discharging amount detected by the discharging state detection means 202, but the discharging direction of droplet from the nozzle greatly deviates or the nozzles discharge small main droplets and many satellite droplets. Such nozzle should be excluded for high-quality image printing. This is the reason that attention is given particularly to the flying speed of droplet upon determining whether discharge of droplet is normal or abnormal.

An application using an A/D converter in place of the comparator 307 will be described. The peak (peak to peak) value of a detection signal is preferably adopted as a physical amount correlative with the discharging amount. The time period until the bottom of the detection signal appears after the rise of a discharge timing signal can be adopted as a physical amount correlative with the discharging speed of droplet.

The effect of a combination of a method of evaluating these two physical amounts and a method of generating a threshold for detecting a non-defectiveness/defectiveness from a detection signal will be explained.

Attention given to the discharge speed is very effective upon determining whether the nozzle is non-defective or defective, as described above. However, many variation factors exist in determining whether the discharging speed is proper. For example, when the liquid droplet is made of ink, the discharging speed of the droplet varies owing to the difference of ink, the ink temperature, the head temperature, or the distance between the printhead 201 and the discharging state detection means 202. Especially as for the distance between the printhead 201 and the discharging state detection means 202, a positional adjustment function of the printhead 201 for adjusting the distance between the printhead 201 and the discharging state detection means 202 is generally attached to an ink-jet printer. If the distance is adjusted, the delay time is different in the above-mentioned method. To compensate for the difference, the position of the printhead upon which the distance is adjusted may be detected and fed back to the decision of the threshold. Alternatively, two sensors for detecting droplet may be arranged in the droplet flying direction to utilize the time difference between the two sensors. However, either method leads to high cost, and it is difficult to determine whether the discharging speed is proper by a conventional fixed or partially variable threshold setting method.

According to the fourth embodiment, however, a threshold is generated from data obtained in the above way, thereby removing all the variation factors. Whether discharge from each nozzle is normal or abnormal can be determined at high precision with a low-cost arrangement.

The processing flow according to the fourth embodiment will be explained again with reference to the flow chart of FIG. 8 on the basis of this premise.

The average values and standard deviations of the delay time and light-shielding time are calculated, and two thresholds (time values) for the delay time and light-shielding time are obtained from the average values and standard deviations in accordance with the processing described in the first embodiment. Formulas for calculating these two thresholds may be different from each other. The calculation method may not use the above-mentioned standard deviation. In step S803, a delay time and light-shielding time which are stored in the memory 309 for each nozzle are compared with their thresholds, and a nozzle whose delay time exceeds the threshold or light-shielding time is shorter than the threshold, is determined as a "defective nozzle". A nozzle which does not satisfy either standard is determined as a "defective nozzle".

The method of evaluating the two physical amounts and the re-inspection method of the second embodiment may be combined. The combination with the re-inspection method can realize higher-precision detection by strictly setting the threshold of the first inspection. Similarly, a method of grouping and processing neighboring nozzles in a nozzle array may be combined. Also in this case, variations depending on the nozzle positions can be suppressed to further increase the precision of determination.

Fifth Embodiment

The fifth embodiment of the present invention will be described. The fourth embodiment has described a combination with the re-inspection method, i.e., the second embodiment. The present inventors have found the fact that, when the flying speed of droplet greatly decreases in a case where a detection processing period of each nozzle is short, droplets of very low flying speed adversely affect the detection of droplets discharged from the next nozzle to be interested. That is, the detection signal of an immediately preceding droplet discharged from a defective nozzle may be superposed as noise on the detection signal of a droplet discharged from a non-defective nozzle, and the nozzle which should be determined to be non-defective may be erroneously determined. Alternatively, the detection signal of an immediately preceding droplet discharged from a defective nozzle may be superposed as noise on the detection signal of a droplet discharged from a defective nozzle, and the nozzle which should be determined to be defective may be erroneously determined.

Figure 10:
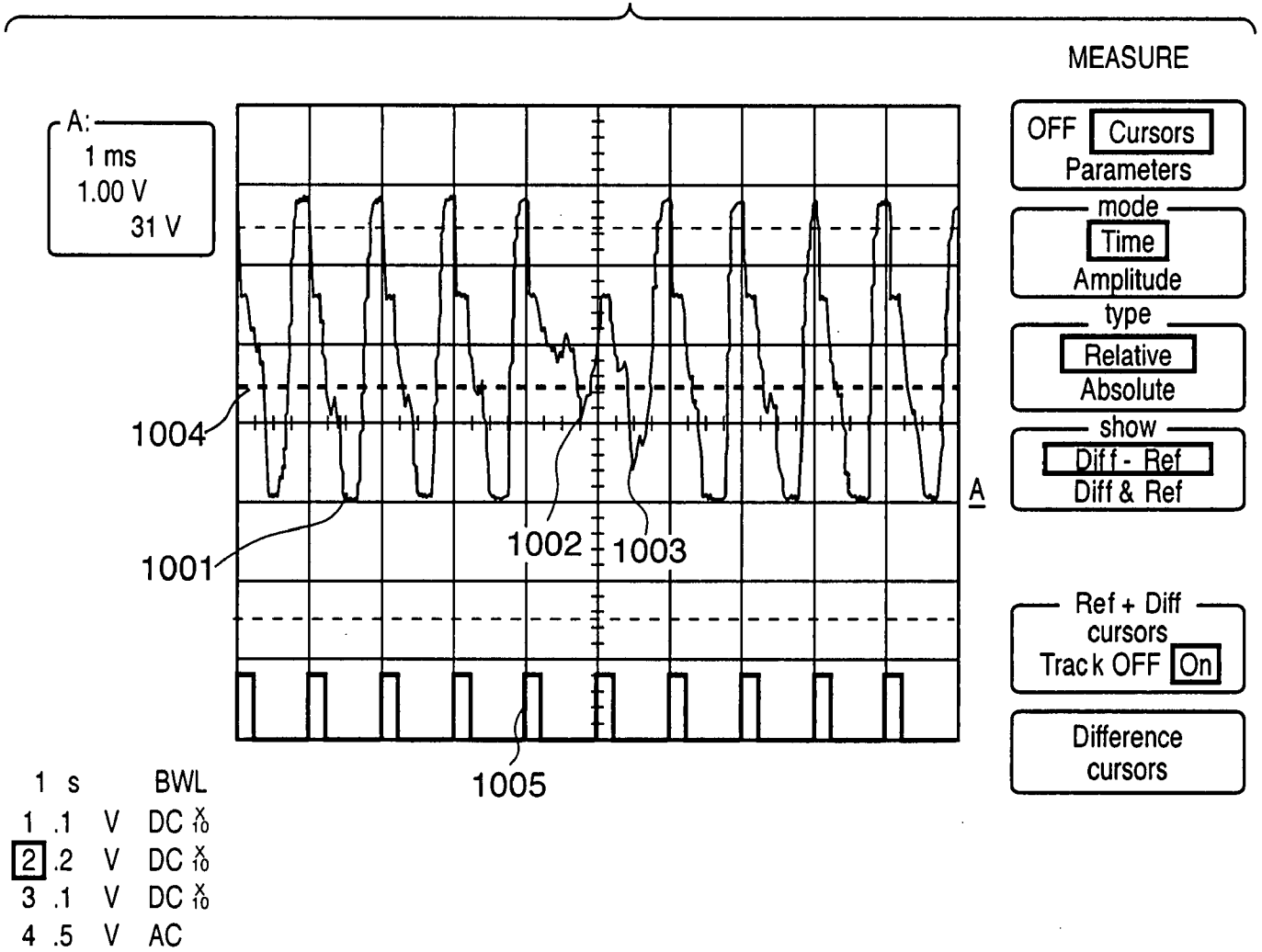
FIG. 10 depicts a waveform chart showing an example of the waveform of a detected voltage signal (detection signal) according to the fifth embodiment of the present invention.

FIG. 10 is a waveform chart showing an example of a measured waveform.

In FIG. 10, reference numeral 1001 denotes a waveform example of a detection signal for a "non-defective nozzle". Reference numeral 1002 denotes a waveform example of a detection signal for a "defective nozzle". Reference numeral 1003 denotes an example of the detection signal of a droplet discharged from a nozzle subsequent to the "defective nozzle". A nozzle determined as a defective nozzle on the basis of a result of actual printing is only a nozzle corresponding to the detection signal 1002. A nozzle corresponding to the signal 1003 does not particularly occur any error in an image printed by the nozzle. Reference numeral 1004 denotes a reference voltage level which is compared by the comparator 307. As a result of determination according to the first embodiment, a nozzle corresponding to the signal 1003 is determined as a "non-defective nozzle", but may be erroneously determined as a "defective nozzle" due to this phenomenon.

To prevent a determination error due to the above phenomenon, the present inventors have devised an arrangement in which, if the delay time obtained in the fourth embodiment exceeds a predetermined value, the detection signal of a subsequent nozzle is assumed to have low reliability, and the nozzle for generating a low-reliability detection signal is added to a group of nozzles to be re-inspected.

In FIG. 10, the delay time (delay time after the rise of a driving signal 1005) until the signal 1002 corresponding to a defective nozzle decreases to be equal to or smaller than the reference voltage 1004, is much longer than that in a normal state. This proves the effectiveness of giving attention to the delay time. In re-inspection, the time period for discharging detection processing of each nozzle must be set longer than that of normal discharge inspection; otherwise, the reliability of a detection signal for a nozzle driven immediately after driving of a defective nozzle becomes low.

In the above-described embodiments, the discharging detection processing cycle of each nozzle is 1 msec. Even if the flying speed of droplet greatly decreases due to a discharge error, it is not confirmed that the delay becomes further 1 msec longer. Hence, up to a nozzle (within 2 msec) inspected next to a nozzle which generates a long delay, suffices to be re-inspected. If, however, the detection processing cycle of each nozzle is shortened from 1 msec, the second and the third nozzles may be subjected to re-inspection. The criterion is a delay of 1 msec as a maximum value.

In many cases, the light-shielding time of a defective nozzle having a long delay time tends to shorten. The delay time is prolonged because droplets fly unstably, and as a result, the light-shielding time shortens. In this case, the detection signal level does not decrease to the reference voltage or less, and the comparison result signal 312 may not change to high level. From the above description, a nozzle corresponding to such detection signal may be generally determined as a "defective nozzle" in the second embodiment. If the re-inspection target nozzle is limited to a nozzle subsequent to the undetermined nozzle, a defective nozzle may be overlooked. For this reason, the re-inspection target nozzle preferably includes a nozzle to be inspected subsequently to the "defective nozzle".

Figure 11:
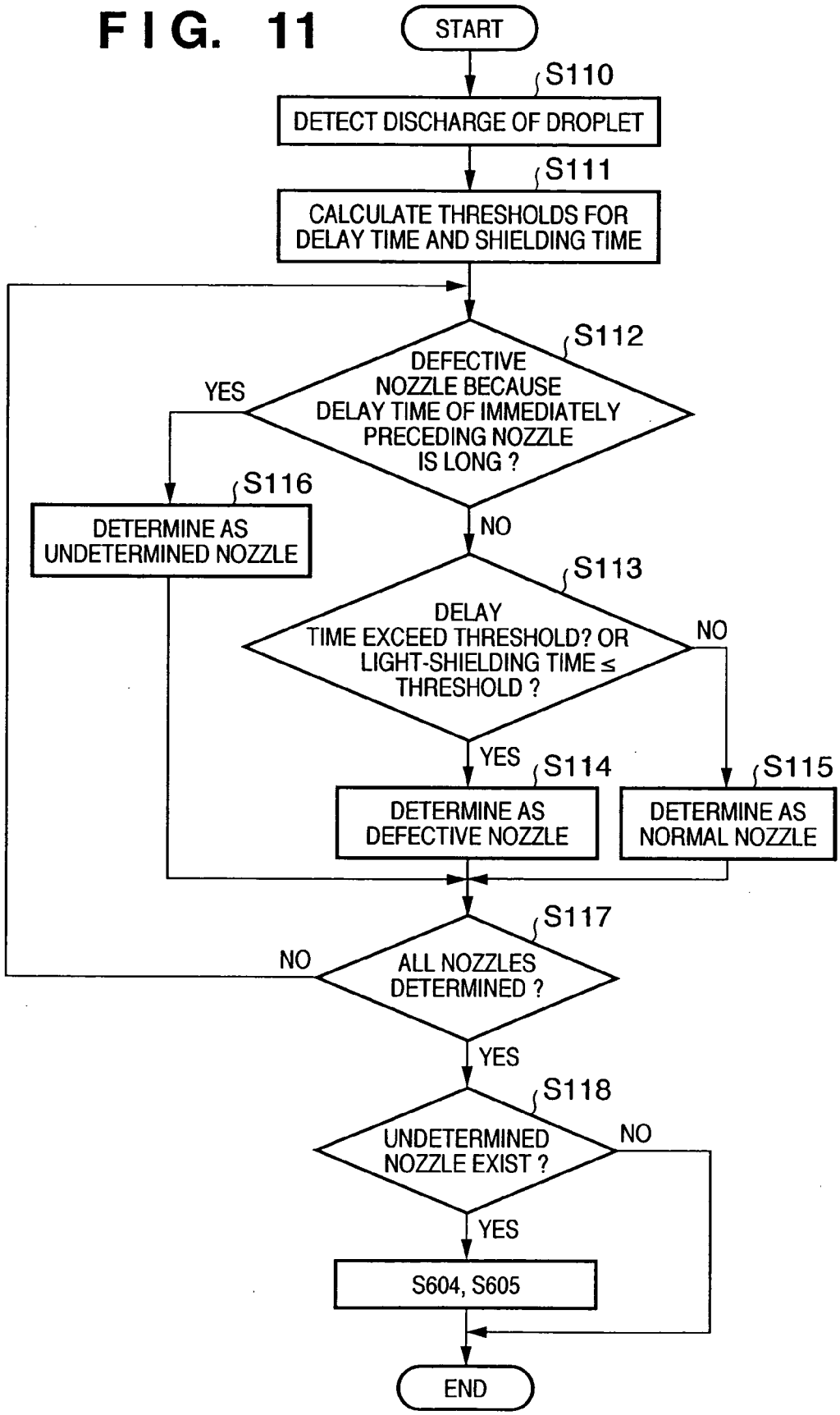
FIG. 11 is a flow chart for explaining determination processing of nozzle in non-defectiveness/defectiveness according to the fifth embodiment of the present invention.

FIG. 11 is a flow chart for explaining nozzle non-defectiveness/defectiveness determination processing according to the fifth embodiment of the present invention.

In step S110, similar to step S101 of FIG. 1, driving for discharging droplet is performed on the printhead towards the discharging state detection means 202 for each nozzle of the printhead 201. Of detection signals obtained by the discharging state detection means 202, two physical amounts (delay time and shielding time) correlative with the discharge amount and discharge speed are stored in the memory 309 for each nozzle (see FIG. 13B). This operation is continuously executed for all the nozzles of the printhead 201. The processing advances to step S111 to statistically evaluate the physical amounts which are detected and stored in the memory 309, and calculate thresholds for the delay time and shielding time for determining droplet discharge. The processing advances to step S112 to determine whether an immediately preceding nozzle is a "defective nozzle" whose delay time is equal to or longer than the threshold. If NO in step S112, the processing advances to step S113 to evaluate the physical amounts of each nozzle stored in the memory 309 by using the obtained thresholds and determine whether the droplet discharging state from the nozzle is normal or abnormal. In this case, similar to FIG. 8, a delay time and light-shielding time stored in the memory 309 for each nozzle are compared with their thresholds. If the delay time exceeds the threshold or the light-shielding time is shorter than the threshold, the processing advances to step s114 to determine the nozzle as a "defective nozzle". If both the conditions are satisfied, the processing advances to step S115 to determine the nozzle as a "non-defective nozzle".

In step S112, if a nozzle which has been driven immediately before the target nozzle is determined as a "defective nozzle" whose delay time is equal to or longer than the threshold, the processing advances to step S116. It can not be determined whether the nozzle is non-defective or defective at this time, and thus the nozzle is determined as an "undetermined nozzle". In step S117, it is determined whether all nozzles of the printhead 201 have been examined, and if NO, the processing returns to step S112 to execute the above-described processing.

After all nozzles of the printhead 201 have been examined, the processing advances to step S118 to determine whether a nozzle determined as an "undetermined nozzle" in step S116 exists. If YES in step S118, the processing advances to steps S604 and S605 of FIG. 6. Detection of droplet discharge, calculation of thresholds, and determination of whether discharge of each nozzle is normal or abnormal are executed again for the nozzle determined as an "undetermined nozzle", and then it is determined whether discharge of the nozzle is normal or abnormal.

The arrangement and operation of an ink-jet printer which adopts the method for detecting a defective nozzle according to the above described embodiments will be explained.

A general arrangement and operation of the ink-jet printer are known to those skilled in the art, and the arrangement will be explained briefly with reference to FIG. 12.

Figure 12:
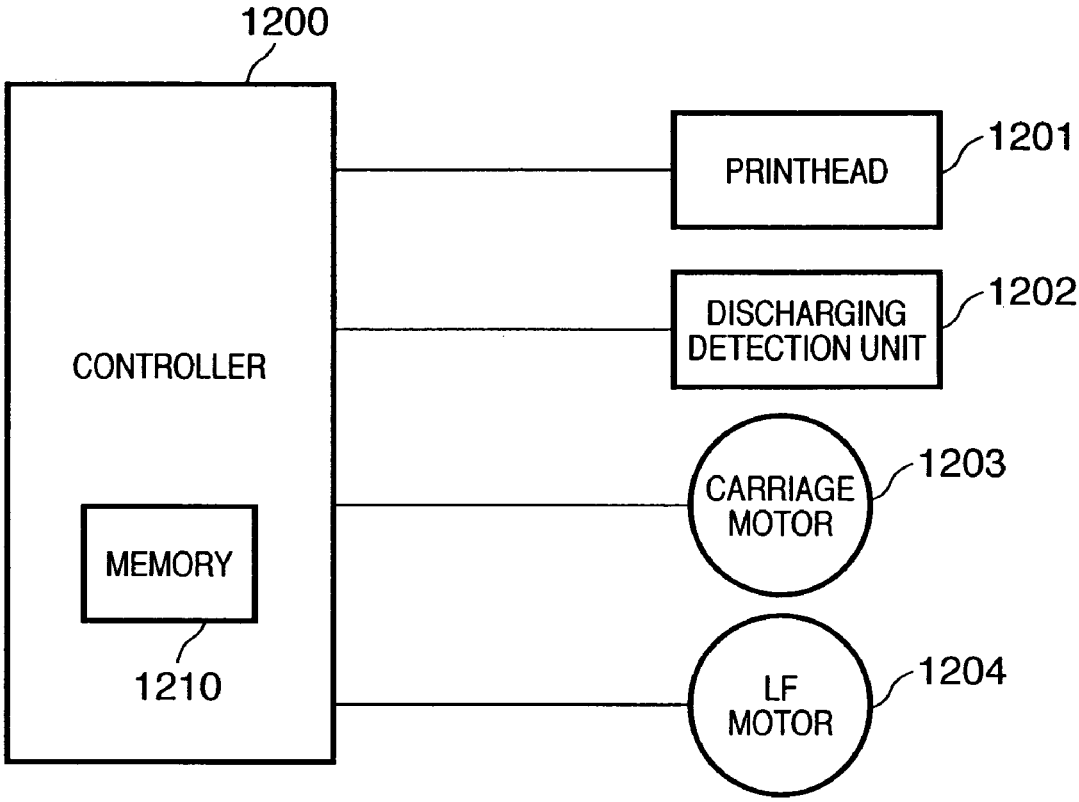
FIG. 12 is a block diagram showing the schematic arrangement of an ink-jet printer according to an embodiment of the present invention.

FIG. 12 depicts a block diagram showing a schematic arrangement of the ink-jet printer according to the embodiments.

Reference numeral 1200 denotes a controller which controls the operation of the overall ink-jet printer. Reference numeral 1201 denotes a printhead which prints by an ink-jet method; and numeral 1202 denotes a discharging detection unit having an arrangement similar to, e.g., the discharging state detection means 202 in FIG. 2. Reference numeral 1203 denotes a carriage motor for scanning and conveying a carriage mounting the printhead 1201; and numeral 1204 denotes an LF motor for conveying a printing sheet. The discharging detection unit 1202 is arranged at, e.g., a home position of the carriage. Each nozzle of the printhead is driven while the printhead 1201 faces the discharging detection unit 1202 (FIG. 2). At this time, the discharging detection unit 1202 detects the ink discharging state from each nozzle in the above-described manner, and determines on the basis of the detection result whether discharge from each nozzle is normal or abnormal. The determination result is sent from the discharging detection unit 1202 to the controller 1200, and the controller 1200 stores the determination result of each nozzle in a memory 1210 of the controller 1200 in correspondence with each nozzle. The controller 1200 can perform processing of, e.g., causing a non-defective nozzle to print instead of a defective nozzle. This correction processing is a known technique, and a detailed description thereof will be omitted.

As for determination of whether discharge of each nozzle is normal or abnormal, a conventional method determines discharge/non-discharge from the nozzle, directly from a detection signal obtained by the discharging state detection means 202. Thus, the conventional method does not require a memory for storing a detected physical amount. However, the embodiments require such memory. For example, if one type of physical amount is stored by 8-bit data for each of 1,280 nozzles of the printhead 1201, a capacity of the memory is necessary for at least 1,280 bytes.

The conventional method may not require any timer because the determination can be done directly from an output from a comparator. To the contrary, the embodiments require the timer 311 (timepiece means) which measures the pulse width of a digital signal output from the comparator 307. Also, a signal representing the discharge timing must be exchanged. However, the timer 311 can be easily implemented by an ASIC and the memory which are originally arranged to constitute an ink-jet printer. No new hardware need be actually added, and the cost does not increase.

The embodiments require a means for calculating a threshold from data stored in the memory, and determining by using the threshold whether the nozzle is non-defective or defective. This means can also be implemented by a CPU which is originally arranged to constitute an ink-jet printer, and the cost does not increase by additional hardware.

In a general ink-jet printer, the head comprises a plurality of nozzle arrays, and the inspection itself is completed for at least each nozzle array. As for the memory 309, an area corresponding to one nozzle array, i.e., a 1,280-byte area in the use of the printhead having 1,280 nozzles suffices to be ensured as far as determination ends before inspection of the next nozzle array. Note that determination results must be independently stored for the nozzles of all the nozzle arrays. Instead of successively discharging droplets from all nozzles of one nozzle array, droplets may be discharged from each group, a threshold may be calculated, and nozzles may be determined. This arrangement can reduce a memory capacity for temporarily holding a physical amount.

In the embodiments, the discharging state detection means 202 is an optical combination of the LED 203 and photodiode 204. However, the present invention is not limited to this, and an induced charge method disclosed in, e.g., Japanese Patent Laid-Open No. 11-170569 can also be adopted. However, the dependence of the sensitivity of the discharging state detection means 202 on the nozzle position is much smaller than that of the optical means. The grouping effect is dominant over the characteristic of the head 201. Japanese Patent Laid-Open No. 11-170569 discloses a technique of inspecting one nozzle a plurality of number of times and averaging the inspection results in order to improve the detection reliability. The embodiments can shorten the total detection time by decreasing the number of inspection operations without decreasing the detection reliability.

Other Embodiment

The present invention may be applied to a system including a plurality of devices (e.g., a host computer, interface device, reader, and printer) or an apparatus (e.g., a copying machine or facsimile apparatus) formed from a single device.

The object of the present invention is also achieved when a storage medium which stores software program codes for realizing the functions of the above-described embodiments is supplied to a system or apparatus, and the computer (or the CPU or MPU) of the system or apparatus reads out and executes the program codes stored in the storage medium.

In this case, the program codes read out from the storage medium realize the functions of the above-described embodiments, and the storage medium which stores the program codes constitutes the present invention.

The storage medium for supplying the program codes includes a floppy disk, hard disk, optical disk, magnetooptical disk, CD-ROM, CD-R, magnetic tape, nonvolatile memory card, and ROM. The functions of the above-described embodiments are realized when the computer executes the readout program codes. Also, the functions of the above-described embodiments are realized when an OS (Operating System) or the like running on the computer performs part of actual processing on the basis of the instructions of the program codes.

Furthermore, the present invention includes a case wherein, after the program codes read out from the storage medium are written in the memory of a function expansion board inserted into the computer or the memory of a function expansion unit connected to the computer, the CPU of the function expansion board or function expansion unit performs part or all of actual processing on the basis of the instructions of the program codes and thereby realizes the functions of the above-described embodiments.

As has been described above, the embodiments sequentially execute the first step of successively performing, for a plurality of nozzles of a printhead, an operation of detecting a droplet discharging state from each nozzle and storing a physical amount representing the detection result while discharge-driving the nozzle of the printhead, the second step of calculating a threshold for determining whether the discharging state from each nozzle is normal or abnormal, by using a plurality of physical amounts stored for the respective nozzles in the first step, and the third step of evaluating the physical amount corresponding to each nozzle on the basis of the threshold and determining whether the discharging state of the nozzle is normal or abnormal. Accordingly, it is determined whether the nozzle is non-defective or defective at high precision regardless of the apparatus difference, environmental difference, or the like.

The embodiments sequentially execute the first step of successively performing, for a plurality of nozzles, an operation of detecting the discharging state of each nozzle and storing a physical amount representing the discharging state while discharge-driving the nozzle of the printhead, the second step of calculating a threshold for determining whether the discharging state of each nozzle is normal or abnormal, by using a plurality of physical amounts stored for the respective nozzles in the first step, the third step of evaluating the physical amount on the basis of the threshold, determining the discharging state of each nozzle, and identifying the nozzle as one of three types: a non-defective nozzle, defective nozzle, and undetermined nozzle; the fourth step of detecting again the discharging state of at least an undetermined nozzle, and the fifth step of determining whether the discharging state of the nozzle is normal or abnormal, on the basis of the physical amount obtained in the fourth step. It is determined at higher precision whether the nozzle is non-defective or defective.

According to the embodiments, a plurality of neighboring nozzles are grouped, and threshold calculation and determination are performed for each group. It can be determined whether the nozzle is non-defective or defective at high precision, regardless of the position of a nozzle to be inspected. This is effective particularly for a long-type of head whose nozzle array length exceeds 1 inch.

According to the embodiments, a physical amount correlative with the discharge amount and a physical amount correlative with the discharging speed are evaluated. Not only simple non-discharge determination, but also the nozzle discharge normality/abnormality determination at high-precision can be achieved in an ink-jet printer for printing a high-quality image.

According to the embodiments, when a nozzle identified as an undetermined nozzle in the third step discharges droplets as the Nth nozzle in the first step, the (N+1)th nozzle which discharges droplets is also identified as an undetermined nozzle in the third step regardless of the detected physical amount. This can prevent any detection error.

According to the embodiments, an ink-jet printer having a droplet detection means comprises a means for successively performing, for a plurality of nozzles, an operation of detecting the discharging state from each nozzle and storing a physical amount representing the discharging state while discharge-driving the nozzle, a means for calculating a threshold for determining whether the discharging state is normal or abnormal, by using a plurality of physical amounts stored for the respective nozzles, and a means for evaluating the physical amount on the basis of the threshold and determining whether the discharging state of each nozzle is normal or abnormal. The embodiments can provide an ink-jet printer capable of determining at high precision whether the nozzle is non-defective or defective. These means can be easily implemented by the building members of a general ink-jet printer.

The present invention is not limited to the above embodiments and various changes and modifications can be made within the spirit and scope of the present invention. Therefore, to apprise the public of the scope of the present invention, the following claims are made.

What is claimed is:

1. A method for determining discharging state from each nozzle of a head which discharges liquid droplets, comprising:

a driving step of driving each nozzle of the head to discharge liquid droplets;

a storage step of detecting a discharging state from each nozzle of the head driven in said driving step and storing the discharging state as a physical amount in a memory;

a calculation step of calculating an average value and a standard deviation of the physical amounts stored in the memory in said storage step and obtaining a threshold for determining whether the discharging state from each nozzle of the head is normal or abnormal, on the basis of the average value and the standard deviation; and a determination step of determining whether the discharging state from each nozzle is normal or abnormal, on the basis of the threshold obtained in said calculation step and the physical amount corresponding to the nozzle, wherein in said calculation step, the threshold is obtained by the average value and the standard deviation×N (N=any one of 3, 4, 5 and 6).

2. A method according to claim 1, wherein in said calculation step, at least two thresholds for determining whether the discharging state from each nozzle of the head is normal or abnormal are calculated, and in said determination step, the physical amount corresponding to each nozzle is evaluated on the basis of the at least two thresholds calculated in said calculation step and it is determined whether the discharging state from each nozzle is normal or abnormal, and further comprising:

a decision step of executing said driving step and said storage step again for an undetermined nozzle determined in said determination step not to be non-defective or defective, and deciding a threshold for determining whether the undetermined nozzle is non-defective; and a step of determining whether the undetermined nozzle is non-defective or defective on the basis of the threshold decided in said decision step.

3. A method according to claim 1, wherein in said calculation step, at least two first thresholds for determining whether the discharging state from each nozzle of the head is normal or abnormal are calculated, and in said determination step, the physical amount corresponding to each nozzle is evaluated on the basis of said at least two first thresholds calculated in said calculation step, and determining whether the discharging state from each nozzle is normal or abnormal; and further comprising:

a step of identifying as an undetermined nozzle a nozzle to be driven next to a nozzle determined in said determination step to be defective;

a decision step of executing said driving step and said storage step again for the nozzle identified as the undetermined nozzle, and deciding a second threshold for determining whether the undetermined nozzle is non-defective; and a step of determining whether the undetermined nozzle is non-defective or defective, on the basis of the second threshold decided in said decision step.

4. The method according to claim 1, wherein a plurality of neighboring nozzles of the head are divided into blocks, the threshold is calculated for each block in said calculation step, and it is determined whether the nozzle is non-defective or defective for each block in said determination step.

5. The method according to claim 1, wherein in said driving step, each nozzle of the head is driven a plurality of times.

6. The method according to claim 1, wherein the physical amount includes a discharging time of droplet.

7. The method according to claim 6, wherein the physical amount includes a delay time until discharged droplet is detected after driving for discharge.

8. An apparatus for determining a discharging state from each nozzle of a head that discharges liquid droplets, comprising:

driving means for driving each nozzle of the head to discharge liquid droplets;

storage means for detecting a discharging state from each nozzle of the head driven by said driving means and storing the discharging state as a physical amount;

calculation means for calculating an average value and a standard deviation of the physical amounts stored by said storage means and obtaining a threshold for determining whether the discharging state of each of the nozzles of the head is normal or abnormal, on the basis of the average value and the standard deviation; and determination means for determining whether the discharging state from each nozzle is normal or abnormal, on the basis of the threshold obtained by said calculation means and the physical amount corresponding to the nozzle, wherein said calculation means obtains the threshold on the basis of the average value and the standard deviation×N (N=any one of 3, 4, 5 and 6).

9. The apparatus according to claim 8, wherein a plurality of neighboring nozzles of the head are divided into blocks, said calculation means calculates the threshold for each block, and said determination means determines for each block whether each nozzle is non-defective or defective.

10. The apparatus according to claim 8, wherein said driving means drives each nozzle of the head a plurality of number of times.

11. An ink-jet printer comprising an apparatus recited in claim 8.

12. The apparatus according to claim 8, wherein the physical amount includes a discharging time of droplet.

13. The apparatus according to claim 12, wherein the physical amount includes a delay time until discharged droplet is detected after driving for discharge.

14. An apparatus for determining a discharging state from each nozzle of a head that discharges liquid droplets, comprising:

driving means for driving each nozzle of the head to discharge liquid droplets;

storage means for detecting a discharging state from each nozzle of the head driven by said driving means and storing the discharging state as a physical amount;

calculation means for calculating an average value and a standard deviation of the physical amounts stored by said storage means and obtaining at least two thresholds for determining whether the discharging state of each of the nozzles of the head is normal or abnormal on the basis of the average value and the standard deviation, wherein one of the thresholds is for determining as normal and another is for determining as abnormal;

determination means for evaluating the physical amount corresponding to each nozzle on the basis of said at least two thresholds obtained by said calculation means, and determining whether the discharging state of the nozzle is normal or abnormal, or undetermined because of the physical amount lying between the one and another thresholds;

decision means for executing processes of said driving means and said storage means again for the undetermined nozzle which is determined by said determination means not to be non-defective or defective, and deciding a threshold for determining whether the undetermined nozzle is non-defective; and means for determining whether the undetermined nozzle is non-defective or defective, on the basis of the threshold decided by said decision means, wherein said calculation means obtains the at least two tresholds on the basis of the average value and the standard deviation×N (N=any one of 3, 4, 5 and 6).

15. An ink-jet printer comprising an apparatus recited in claim 14.

16. An apparatus for determining a discharging state from each nozzle of a head that discharges liquid droplets, comprising:

driving means for driving each nozzle of the head to discharge liquid droplets;

storage means for detecting a discharging state from each nozzle of the head driven by said driving means and storing the discharging state as a physical amount;

calculation means for calculating an average value and a standard deviation of the physical amounts stored by said storage means and obtaining at least two first thresholds for determining whether the discharging state of each of the nozzles of the head is normal or abnormal, on the basis of the average value and the standard deviation, wherein one of the thresholds is for determining as normal and another is for determining as abnormal;

determination means for evaluating the physical amount corresponding to each nozzle on the basis of said at least two first thresholds obtained by said calculation means, and determining whether the droplet discharging state of the nozzle is normal or abnormal, or undetermined because of the physical amount lying between the one and another thresholds;

means for identifying as an undetermined nozzle, a nozzle to be driven next to a nozzle determined by said determination means to be undetermined;

decision means for executing processes of said driving means and said storage means again for the nozzle identified as the undetermined nozzle, and deciding a second threshold for determining whether the undetermined nozzle is non-defective or defective; and means for determining whether the undetermined nozzle is non-defective or defective, on the basis of the second threshold decided by said decision means, wherein said calculation means obtains the at least two first tresholds on the basis of the average value and the standard deviation×N (N=any one of 3, 4, 5 and 6).

17. An ink-jet printer comprising an apparatus recited in claim 16.

18. A method for determining discharging state from each nozzle of a head which discharges liquid droplets, comprising:

a driving step of driving each nozzle of the head to discharge liquid droplets;

a storage step of detecting a discharging state from each nozzle of the head driven in said driving step and storing the discharging state as a physical amount in a memory;

a calculation step of calculating a median value and a standard deviation of the physical amounts stored in the memory in said storage step and obtaining a threshold for determining whether the discharging state from each of nozzles of the head is normal or abnormal, on the basis of the median value and the standard deviation; and a determination step of determining whether the discharging state from each nozzle is normal or abnormal, on the basis of the threshold obtained in said calculation step and the physical amount corresponding to the nozzle, wherein in said calculation step the threshold is obtained on the basis of the median value and the standard deviation×N (N=any one of 3, 4, 5 and 6).

19. An apparatus for determining a discharging state from each nozzle of a head that discharges liquid droplets, comprising:

driving means for driving each nozzle of the head to discharge liquid droplets;

storage means for detecting a discharging state from each nozzle of the head driven by said driving means and storing the discharging state as a physical amount;

calculation means for calculating a median value and a standard deviation of the physical amounts stored by said storage means and obtaining a threshold for determining whether the discharging state of each of the nozzles of the head is normal or abnormal, on the basis of the median value and the standard deviation; and determination means for determining whether the discharging state from each nozzle is normal or abnormal, on the basis of the threshold obtained by said calculation means and the physical amount corresponding to the nozzle, wherein said calculation means obtains the threshold on the basis of the median value and the standard deviation×N (N=any one of 3, 4, 5 and 6).

* * * * *

UNITED STATES PATENT AND TRADEMARK OFFICE

CERTIFICATE OF CORRECTION

PATENT NO. : 7,108,347 B2
APPLICATION NO. : 10/705313
DATED : September 19, 2006
INVENTOR(S) : Miyashita It is certified that error appears in the above-identified patent and that said Letters Patent is hereby corrected as shown below:

On the Title Page, item (56), Reference Cited, U.S. Patent Documents, change "6,517,183 B1* 2/2003 Burch et al. ...347/19" to --6,517,183 B1* 2/2003 Burch et al. ...347/19--.

In Column 24, Line 2, change "tresholds" to --thresholds--; and

Line 42, change "tresholds" to --thresholds--.

Signed and Sealed this

Thirteenth Day of February, 2007

JON W. DUDAS
*Director of the United States Patent and Trademark Office*